US005499804A

United States Patent [19]

Harada et al.

[11] Patent Number: 5,499,804

[45] Date of Patent: Mar. 19, 1996

[54] PAPER CONVEYING DEVICE AND PAPER CONVEYING METHOD

[75] Inventors: Hiroyuki Harada; Yasuhiko Kida, both of Osaka, Japan

[73] Assignee: Mita Industrial Co., Ltd., Osaka, Japan

[21] Appl. No.: 77,010

[22] Filed: Jun. 15, 1993

[30] Foreign Application Priority Data

| | | | |
|---|---|---|---|
| Jun. 15, 1992 | [JP] | Japan | 4-155363 |
| Jun. 15, 1992 | [JP] | Japan | 4-155364 |
| Jun. 15, 1992 | [JP] | Japan | 4-155365 |

[51] Int. Cl.[6] ..... B65H 5/22

[52] U.S. Cl. ..... 271/3.02; 355/317; 271/3.05; 271/3.13; 271/227; 271/229; 271/230; 271/265.01; 271/270; 271/275; 271/902

[58] Field of Search ..... 271/3, 226, 227, 271/229, 230, 245, 258, 265, 270, 275, 902; 355/317

[56] References Cited

U.S. PATENT DOCUMENTS

| | | | |
|---|---|---|---|
| 4,455,018 | 6/1984 | Colglazier | 271/227 |
| 4,917,371 | 4/1990 | Bastow et al. | 271/275 X |
| 5,035,414 | 7/1991 | Shibanaka et al. | 271/227 |
| 5,056,775 | 10/1991 | Kida | 271/265 X |
| 5,323,219 | 6/1994 | Hamanaka et al. | 355/317 X |

FOREIGN PATENT DOCUMENTS

| | | | |
|---|---|---|---|
| 87114155.2 | 4/1988 | European Pat. Off. | G03G 15/00 |
| 90113174.8 | 1/1991 | European Pat. Off. | G03G 15/00 |
| 90114376.8 | 1/1991 | European Pat. Off. | G03G 15/00 |
| 55332 | 3/1985 | Japan | 355/317 |
| 61-174538 | 8/1986 | Japan | G03B 27/62 |
| 5-22975 | 1/1993 | Japan | H02P 5/00 |

OTHER PUBLICATIONS

Xerox Disclosure Journal, vol. 15, No. 5, Sep./Oct. 1990 "Document Registration Control Algorithm", K. J. Buck.

*Primary Examiner*—William E. Terrell
*Assistant Examiner*—Carol L. Druzbick
*Attorney, Agent, or Firm*—R. Lawrence Sahr

[57] ABSTRACT

A paper conveying device for overrunning paper from a stop position and then, switching the paper back to stop the paper in a stop position. The driving of a paper conveying section for conveying paper is stopped at the time point where the rear end of the paper reaches the stop position. Thereafter, the amount of overrun of the paper is detected, so that the paper is switched back by the amount. Consequently, the amount of overrun and the amount of switchback of the paper are suppressed to the minimum amounts required. In addition, the stress applied to the paper is reduced, and the paper is set in a short time.

14 Claims, 15 Drawing Sheets

Fig. 13

| DOCUMENT SIZE | TARGET STOPPING TIME | TYPE OF DOCUMENT |
|---|---|---|
| A3Y<br>A3R<br>B3Y<br>B4Y<br>A2R | 90msec | THIN DOCUMENT<br>(SDF MODE) |
| A4Y<br>A4R<br>B5Y<br>B5R | 30msec | ORDINARY DOCUMENT<br>(ADF MODE) |

Fig. 15

| DOCUMENT SIZE | TARGET STOPPING DISTANCE | TYPE OF DOCUMENT |
|---|---|---|
| A3Y<br>A3R<br>B3Y<br>B4Y<br>A2R | 45mm | THIN DOCUMENT<br>(SDF MODE) |
| A4Y<br>A4R<br>B5Y<br>B5R | 21mm | ORDINARY DOCUMENT<br>(ADF MODE) |

PAPER CONVEYING DEVICE AND PAPER CONVEYING METHOD

BACKGROUND OF THE INVENTION

1. Field of the Invention

The present invention relates generally to a paper conveying device for conveying paper such as a document, and more particularly, to an automatic paper conveying device mounted on an electrophotographic copying machine or the like for automatically setting paper such as a document in a predetermined position.

2. Description of the Related Art

An automatic document conveying device mounted on an electrophotographic copying machine, a facsimile or the like for conveying a document (paper) so as to automatically set the document in a predetermined position has been known.

Many of conventional automatic document conveying devices include a mechanism for conveying a document by a conveying belt. In this type of automatic document conveying device, control is so carried out that when the document is set, the front end or the rear end of the document is stopped along a predetermined reference line.

One example of methods of control conventionally carried out so as to exactly set the end of a document along a reference line is a system of overrunning once the end of a document by a predetermined amount from the position where the document is to be set and then, driving a conveying belt in the reverse direction to switch the document back so that the end of the document collides with a projection provided in the position of the reference line. In such a system of switching the document back, control for overrunning the document and switching the document back has been conventionally managed by time.

Furthermore, there has been a method of rotating a motor for driving a conveying belt in the reverse direction although the motor is not completely stopped at the time of overrunning a document once and then, driving the conveying belt in the reverse direction.

Meanwhile, the above described system of switching the document back so that the end of the document collides with the projection provided in the position of the reference line has the disadvantage in that the stress is applied to the document at the time of the collision, so that the document is liable to be, for example, wrinkled or folded. In particular, the amount of overrun and the amount of switchback of the document have been conventionally managed by time as described above, so that sufficient time to manage the amounts must be set. Therefore, the system has the disadvantage in that the stress applied to the document is increased.

Furthermore, the document is overrun by a distance greater than necessary and switched back. Therefore, the system also has the disadvantage in that it takes long to set the document and it also takes long to replace the document with another document.

On the other hand, in the method of rotating the motor for driving a conveying belt in the reverse direction before the motor is completely stopped at the time of switching the document back, time required for control may be short. Since a large force is exerted on the conveying belt, however, a large frictional force is produced between the conveying belt and the document and slip occurs therebetween. Therefore, the method has several disadvantages. For example, the document is damaged, the alignment precision of the document is degraded, or a static charge is produced.

SUMMARY OF THE INVENTION

A first object of the present invention is to provide a paper conveying device in which the above described disadvantages in the prior art are overcome.

A second object of the present invention is to provide a paper conveying device in which the stress applied to paper can be reduced, so that the paper is hardly damaged.

A third object of the present invention is to provide a paper conveying device in which time required until paper is stopped in a predetermined position may be short.

The more detailed object of the present invention is to provide, in a paper conveying device of a type of overrunning paper such as a document from a stop position and then switching the paper back so that the end of the paper collides with a projection provided in the stop position, a paper conveying device in which the stress applied to the paper can be reduced, so that the paper is hardly damaged, and time required until the paper is stopped in a predetermined position may be short by improving control of a motor for driving a conveying mechanism to overrun the paper by the minimum distance required and switch the paper back by the amount of overrun.

In the present invention, when the paper reaches a predetermined position, the driving of a paper conveying section for conveying the paper is stopped. Thereafter, the paper conveying section coasts by the inertia, so that the paper is overrun from the reference position. At this time, the distance which the paper conveying section coasts by the inertia is detected, so that the actual stop position of the paper is confirmed. Thereafter, the paper conveying section is driven in the reverse direction, so that the paper is returned to the reference position.

Consequently, the paper is overrun by the minimum distance required, and the paper is switched back by the amount of overrun. As a result, the stress applied to the paper can be reduced, so that the paper is hardly damaged, and time required until the paper is stopped in a predetermined position may be short.

Meanwhile, the paper conveying section may be so controlled as to be decelerated with the elapse of time and with the increase in moving distance after the driving of the paper conveying section is stopped. Consequently, the paper conveying section can be stopped in a short time. Moreover, when the paper conveying section is stopped, the paper do not slip, thereby to make it possible to exactly set the paper in the reference position.

The present invention comprises a paper conveying device comprising:

paper conveying means moved in a first direction to convey paper in the first direction and moved in a second direction to convey the paper in the second direction;

pulse outputting means for outputting pulses in synchronism with the movement of the paper conveying means;

driving signal outputting means for applying a driving signal to the paper conveying means to move the paper conveying means in the first direction and stopping the application of the driving signal at timing when the paper conveyed in the first direction by the paper conveying means is conveyed to a predetermined position;

counting means for counting a number of pulses outputted from the pulse outputting means after the application of the driving signal from the driving signal outputting means is stopped so as to detect a distance at which the paper conveying means is moved by its inertia even after the application of the driving signal is stopped; and position controlling means for moving the paper conveying means in the second direction by a distance corresponding to the number of pulses counted.

Said position controlling means of said paper conveying device may comprise means for moving the paper conveying means in the second direction at a speed proportional to said number of pulses counted and means for varying said number of pulses counted by a number of pulses outputted from the pulse outputting means as the paper conveying means is moved in the second direction, and so controls that a speed at which the paper conveying means is moved is not more than a predetermined speed in the vicinity of a target position where the movement in the second direction is terminated.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 13 is an illustration showing a memory map on which one example of the target stopping time is set;

FIG. 15 is an illustration showing a memory map on which one example of the target stopping distance is set.

DESCRIPTION OF PREFERRED EMBODIMENTS

Description is made of control of a document conveying motor in an automatic document conveying device mounted on an electrophotographic copying machine or the like by way of example as one embodiment of the present invention.

Figure 1:
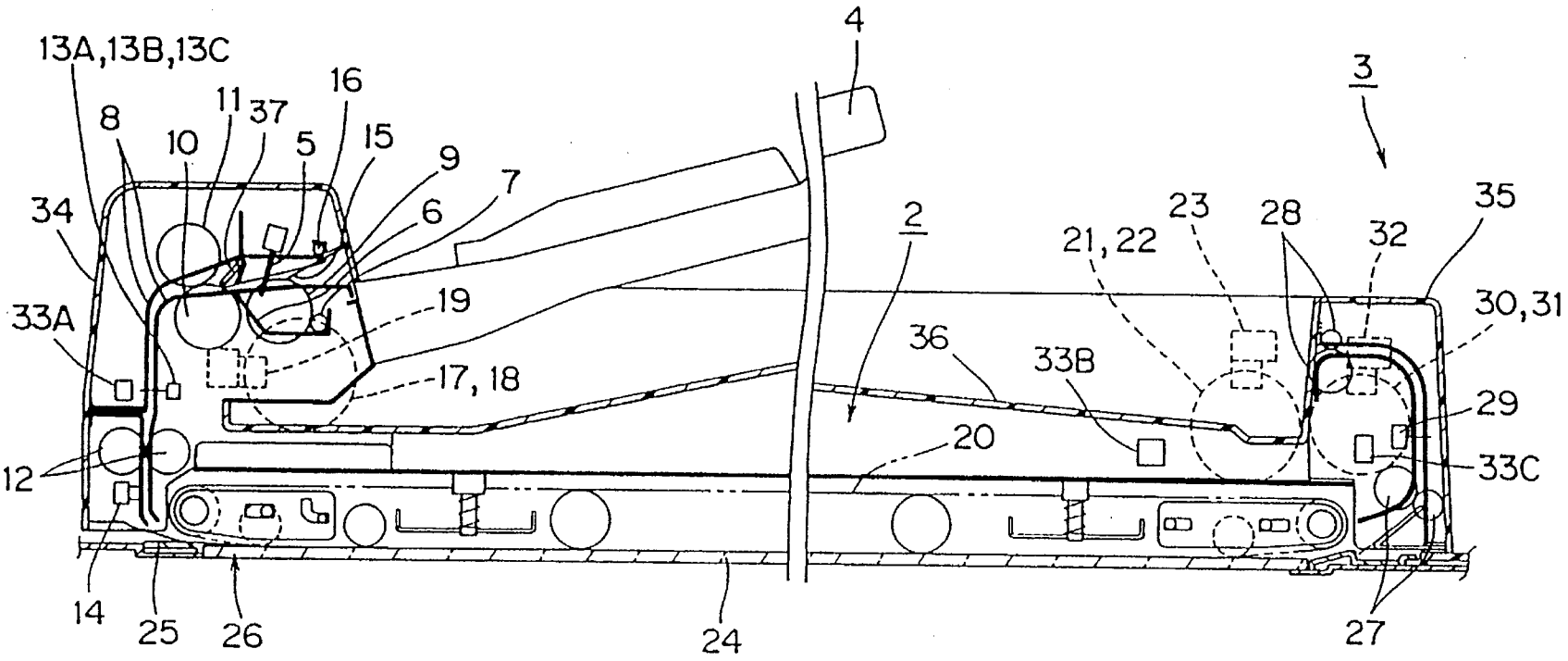
FIG. 1 is a sectional side elevation showing an automatic document conveying device to which one embodiment of the present invention is applied.

FIG. 1 is a sectional side elevation showing an automatic document conveying device to which one embodiment of the present invention is applied. This automatic document conveying device comprises a paper feeding section 1, a belt conveying section 2, and a paper discharging section 3.

The paper feeding section 1 comprises a document setting stand 4, a document setting switch 5 for detecting, when a document is properly set on the document setting stand 4, the setting of the document, a stopper member 6, and a document pressing member 15.

The stopper member 6 is provided so as to be rotatable around a supporting point 7 and abuts against the front end of the document in a position as shown in the figure when the document is not fed, to prevent the document from being fed. On the other hand, the stopper member 6 is rotated in the counterclockwise direction around the supporting point 7 when the document is fed, to allow the document to be fed.

The document pressing member 15 is provided so as to be slidable around a supporting point 16 and can be switched by a solenoid (not shown) between a state where the forward end thereof is pushed downward and a state where the forward end thereof is not pushed down. This document pressing member 15 is for exerting a force not less than its own weight to the document at the time of paper feeding to press the document against a forward roller 9 as described below.

The paper feeding section 1 further comprises a conveying guide 8 for guiding the document fed, the forward roller 9 for forwarding the document, a pair of a paper feeding roller 10 and a reverse roller 11 for preventing documents from being fed with they being overlapped with each other to feed the documents one at a time, a separation plate 37 provided just ahead of the paper feeding roller 10 for separating the documents fed to the paper feeding roller 10 from each other, a pair of registration rollers 12 for feeding the document by secondary paper feeding to the belt conveying section 2 at predetermined timing, and a registration switch 13A and size switches 13B and 13C provided on the upstream side of the registration roller 12 for detecting, when the document is fed to the registration roller 12, the feeding of the document. The registration switch 13A and the size switches 13B and 13C are disposed in the direction orthogonal to the surface of the figure. In addition, a feed switch 14 for detecting the document fed by secondary paper feeding to the belt conveying section 2 is included on the downstream side of the registration roller 12.

The paper feeding section 1 further comprises a paper feeding motor 17 serving as a driving source. The torque produced by the paper feeding motor 17 is transmitted to the forward roller 9 and the paper feeding roller 10 through a paper feeding clutch (not shown), and is further transmitted to the registration roller 12 through a registration clutch (not shown). The paper feeding motor 17 is provided with a rotating disc 18 mounted on its axis of rotation and having a lot of slits, for example, in a radial manner and a photo-interrupter for a paper feeding motor 19 optically coupled to the rotating disc 18. Accordingly, it is possible to detect the rotating state of the paper feeding motor 17 by an output pulse of the photointerrupter for a paper feeding motor 19.

The belt conveying section 2 comprises a conveying belt 20 for conveying the document and a conveying motor 21 for driving the conveying belt 20. The conveying motor 21 is also provided with a rotating disc 22 mounted on its axis of rotation and having a lot of slits, for example, in a radial manner and a photointerrupter for a conveying motor 23 optically coupled to the rotating disc 22. Accordingly, it is possible to detect the rotating state of the conveying motor 21 by an output pulse of the photointerrupter for a conveying motor 23.

The lower surface of the conveying belt 20 is brought into contact with a transparent platen 24 mounted on the electrophotographic copying machine. A document abutting member 25 is mounted on the side of the forward end (on the left side in the figure) of the transparent platen 24. The document abutting member 25 has a projected end side having a difference in level from the surface of the transparent platen 24, and this end side constitutes a reference line 26 in a case where the document is set on the transparent platen 24.

The paper discharging section 3 comprises a pair of document feeding rollers 27, a pair of discharge rollers 28, a discharge switch for detecting the document discharged, and a discharged paper receiving section 36. In addition, there is provided a discharge motor 30 serving as a driving source of the paper discharging section 3. This discharge motor 30 is also provided with a rotating disc 31 mounted on its axis of rotation and having a lot of slits, for example, in a radial manner and a photointerrupter for a discharge motor 32 optically coupled to the rotating disc 31. Accordingly, it is possible to detect the rotating state of the discharge motor 30 by an output pulse of the photointerrupter for a discharge motor 32.

This automatic document conveying device further comprises three safety switches 33A, 33B and 33C (generically called "safety switches 33"). The safety switch 33A is a switch which is turned off when a cover 34 of the paper feeding section 1 is opened, the safety switch 33B is a switch which is turned off when the belt conveying section 2 is lifted from the transparent platen 24, and the safety switch 33C is a switch which is turned off when a cover 35 of the paper discharging section 3 is opened. This automatic document conveying device can be operated when all the safety switches 33 are turned on.

Figure 2:
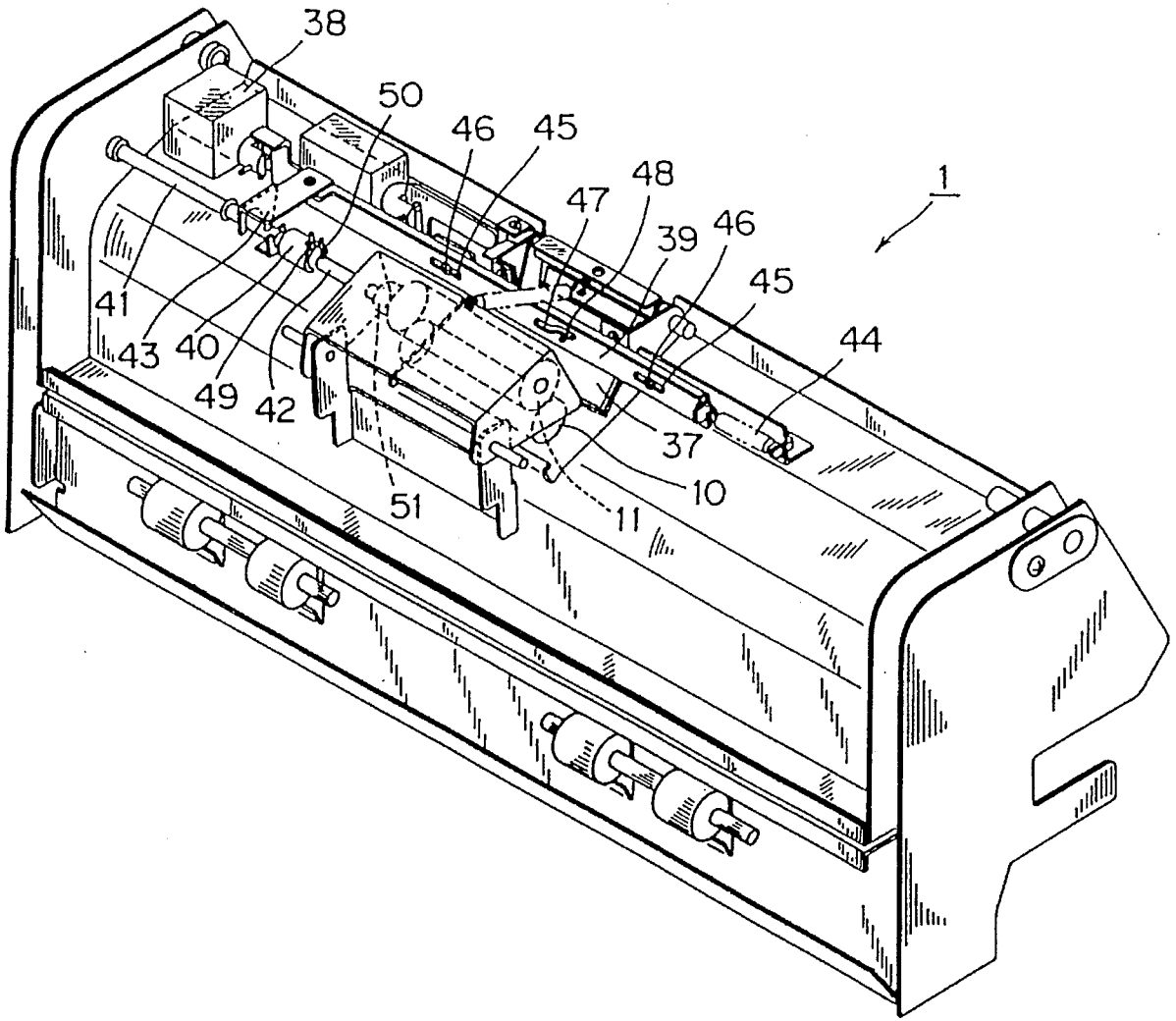
FIG. 2 is a perspective view showing the construction of a paper feeding section in the automatic document conveying device shown in FIG. 1.

FIG. 2 is a perspective view showing the construction of the paper feeding section 1 in the automatic document conveying device. Referring to FIG. 2, the construction of the paper feeding section 1 will be additionally described.

The paper feeding section 1 can be switched between an ADF mode in which documents are so separated from each other as to be fed one at a time by a separation plate 37 and a reverse roller 11 and an SDF mode in which documents are not separated from each other in such a manner that the separation plate 37 and the reverse roller 11 do not function. Therefore, the paper feeding section 1 comprises an SDF solenoid for mode switching 38, a sliding plate 39 which has its one end connected to the SDF solenoid 38 and is slid in the lateral direction by switching the on and off states of the SDF solenoid 38, and a joint mechanism 40.

The sliding plate 39 is a longitudinal plate-shaped member as shown in the figure. A return spring 44 is connected to an end opposite to the end to which the SDF solenoid 38 is connected. When the SDF solenoid 38 is turned off, the sliding plate 39 is pulled rightward in the figure by the return spring 44. Two long holes 45 extending in the direction of sliding are formed in the sliding plate 39, and the long holes 45 are respectively fitted in supporting pins 46. Consequently, the sliding plate 39 is slidable in the lateral direction within the range of the length of the long hole 45.

A stepped hole 47 is also formed in the sliding plate 39, and an engaging pin 48 projected from the separation plate 37 engages with the stepped hole 47. When the sliding plate 39 is slid leftward as shown in the figure, the engaging pin 48 engages with the upper step of the stepped hole 47. Accordingly, the engaging pin 48 is displaced upward, resulting in a state where the separation plate 37 is not brought into contact with the peripheral surface of the paper feeding roller 10. On the other hand, when the sliding plate 39 is slid rightward, the engaging pin 48 engages with the lower step of the stepped hole 47. Accordingly, the engaging pin 48 is displaced downward, resulting in a state where the separation plate 37 is moved downward to be brought into contact with the peripheral surface of the paper feeding roller 10, to separate the documents from each other.

The joint mechanism 40 is a mechanism which can be switched between a state where the torque produced by a driving shaft 41 is transmitted to a roller shaft 42 to which the reverse roller 11 is attached and a state where it is not transmitted thereto. The sliding plate 39 and the joint mechanism 40 are connected to each other by an adjusting plate 43 so that the above described switching of the joint mechanism 40 is allowed in synchronism with the sliding of the sliding plate 39.

More specifically, when the sliding plate 39 is slid leftward, the joint mechanism 40 is moved leftward in synchronism with the sliding of the sliding plate 39, resulting in a state where the joint mechanism 40 is disconnected from the roller shaft 42, as shown in FIG. 2. In this state, the torque produced by the driving shaft 41 is not transmitted to the roller shaft 42. On the other hand, when the sliding plate 39 is slid rightward, the joint mechanism 40 is moved rightward in synchronism with the sliding of the sliding plate 39, resulting in a state where an engaging recession 49 formed in the joint mechanism 40 and an engaging pin 50 formed in the roller shaft 42 are fitted to each other, so that the joint mechanism 40 and the roller shaft 42 are connected to each other. In this state, the torque produced by the driving shaft 41 is transmitted to the roller shaft 42, so that the reverse roller 11 can be rotated in the reverse direction through a limiter 51.

Since the paper feeding section 1 is thus constructed, the sliding plate 39 and the joint mechanism 40 can be slid leftward by turning the SDF solenoid 38 on, while the sliding plate 39 and the joint mechanism 40 can be slid rightward by turning the SDF solenoid 38 off. The on and off states of the SDF solenoid 38 can be switched depending on whether or not the SDF mode is selected, as described later.

Figure 3:
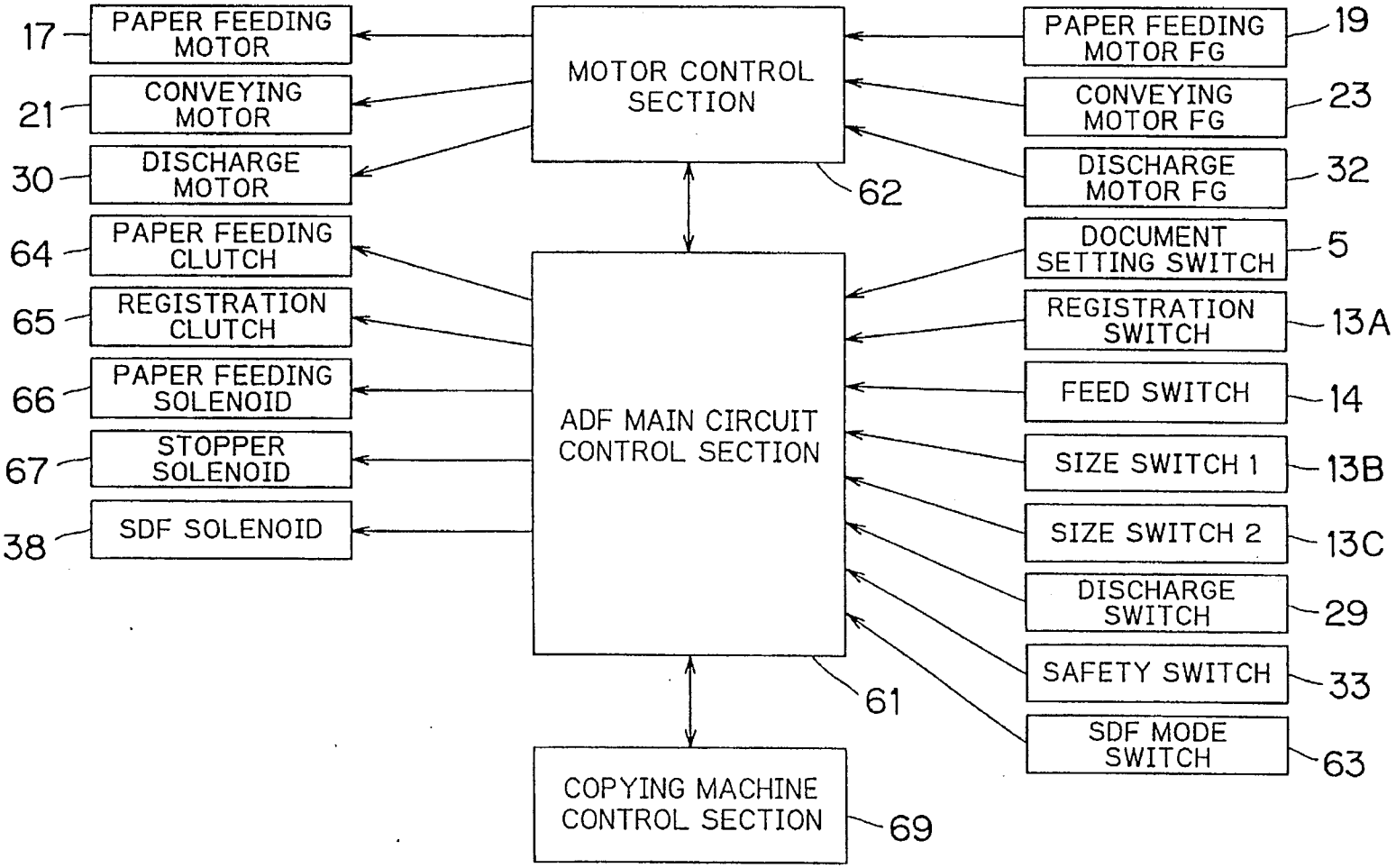
FIG. 3 is a block diagram showing the electrical construction of the automatic document conveying device shown in FIG. 1.

FIG. 3 is a block diagram showing the electrical construction of this automatic document conveying device. The automatic document conveying device comprises an ADF main circuit control section 61 provided with a microcomputer and the like and a motor control section 62 similarly provided with a microcomputer and the like. Both the control sections 61 and 62 are electrically connected to each other.

Signals of a registration switch 13A, a size switch 13B, a size switch 13C, a feed switch 14, a discharge switch 29, and three safety switches 33 are applied to the ADF main circuit control section 61. In addition, a signal of an SDF mode switch 63 provided in an operation panel (not shown) or the like for setting an SDF mode is also applied thereto.

The ADF main circuit control section 61 applies a control signal to the motor control section 62 on the basis of the signals from the respective switches. In addition, the control signal outputted from the ADF main circuit control section 61 is applied to a paper feeding clutch 64 for transmitting or disconnecting the torque produced by a paper feeding motor 17 described in FIG. 1 to and from a forward roller 9 and a paper feeding roller 10, a registration clutch 65 for transmitting or disconnecting the torque produced by the paper feeding motor 17 to and from a registration roller 12, a paper feeding solenoid 66 for switching the state of a document pressing member 15, a stopper solenoid 67 for switching the state of a stopper member 6, and an SDF solenoid 38 described in FIG. 2.

On the other hand, output pulses of a photointerrupter for a paper feeding motor 19, a photointerrupter for a conveying motor 23, and a photointerrupter for a discharge motor 32 are applied to the motor control section 62. The motor control section 62 controls the paper feeding motor 17, a conveying motor 21, and a discharge motor 30 on the basis of the pulses from the respective photointerrupters 19, 23 and 32 and the control signal from the ADF main circuit control section 61.

Furthermore, a copying machine control section 69 and the ADF main circuit control section 61 are electrically connected to each other so that this automatic document conveying device mounted on a copying machine is controlled by the copying machine control section 69 of the copying machine.

Figure 4:
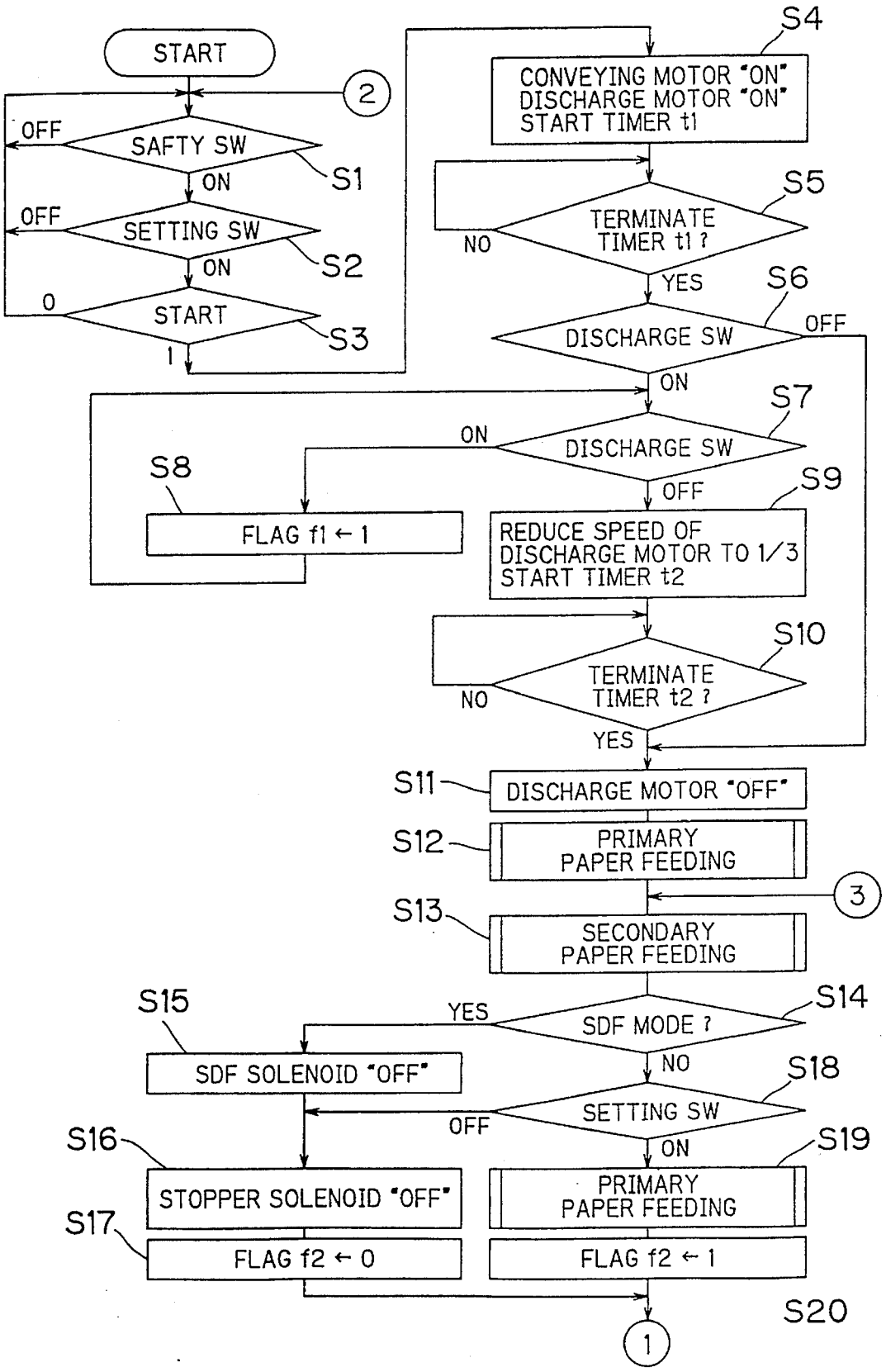
FIG. 4 is a flow chart showing the procedure for control carried out by an ADF main circuit control section and a motor control section.
Figure 5:
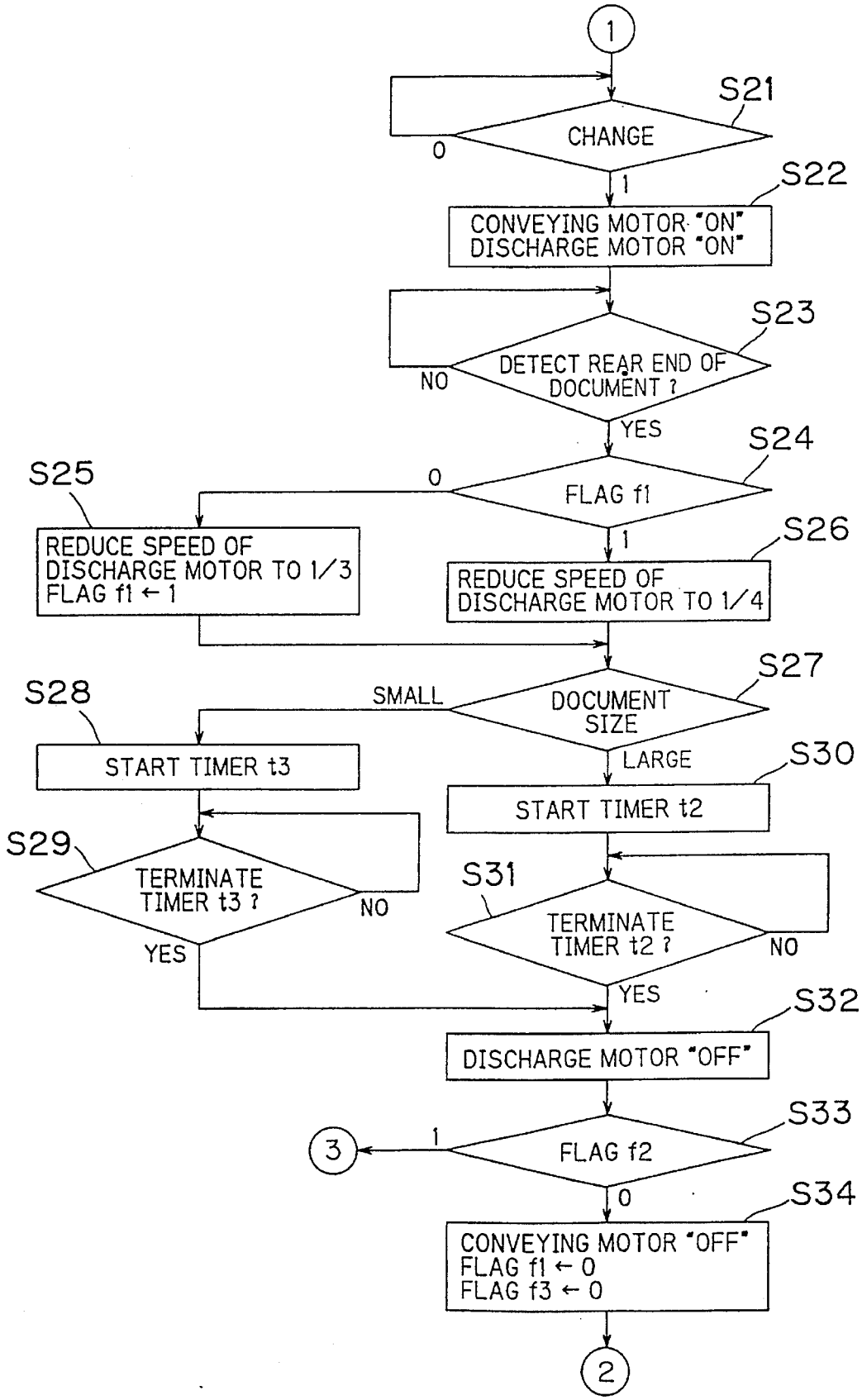
FIG. 5 is a flow chart showing the procedure for control carried out by an ADF main circuit control section and a motor control section.

FIGS. 4 and 5 are flow charts showing the procedure for control carried out by the ADF main circuit control section 61 and the motor control section 62 shown in FIG. 3.

Description is now made while referring to FIGS. 1 and 3 in accordance with the flow of FIGS. 4 and 5.

When control is started, it is judged whether or not the safety switches 33 are turned on (step S1). When any one of the safety switches 33 is turned off, a control operation is not performed because either the covers 34 or 35, for example, is opened.

When it is confirmed that all the safety switches 33 are turned on, it is then judged whether or not the document setting switch 5 is turned on (step S2). When a document is set on the document setting stand 4, the document setting switch 5 is turned on. At this time, it is further judged whether or not a "START" signal indicating the start of control is applied from the copying machine control section 69 (step S3).

If all the conditions in the steps S1 to S3 are established, control for left document recovery processing in the steps S4 to S11 is first carried out. This control is as follows:

The conveying motor 21 and the discharge motor 30 are turned on, so that a timer t1 is started (step S4). The timer t1 measures very short first predetermined time required until left documents on, for example, the transparent platen 24 are fed to the paper discharging section 3 by the conveying belt 20. When the measurement of time made by the timer t1 is terminated (step S5), the state of the discharge switch 29 is judged (step S6). If the discharge switch 29 is turned off, there are no left documents, so that the discharge motor 30 is turned off (step S11).

On the other hand, if the discharge switch 29 is turned on, there are left documents, so that a flag f1 is set (step S8), and the program waits until the discharge switch 29 is turned off (step S7). The flag f1 is a flag for indicating whether or not there is a document on the discharged paper receiving section 36. When the flag f1 is set, there is a document on the discharged paper receiving section 36.

When the discharge switch 29 is turned off, it is considered that the rear end of the document discharged passes through the discharge switch 29. At this time point, therefore, the speed of the discharge motor 30 is reduced to, for example, one third, so that a timer t2 is started (step S9). The discharge motor 30 is decelerated so as to prevent the document discharged to the discharged paper receiving section 36 from being jumped out too vigorously causing a disarrangement of documents.

Furthermore, the timer t2 measures second predetermined time required until the rear end of the document detected by the discharge switch 29 is discharged from the discharge roller 28.

When the measurement of time made by the timer t2 is terminated (step S10), the discharge motor 30 is turned off (step S11).

The left documents are removed in the foregoing manner, followed by primary paper feeding (step S12). The primary paper feeding is to feed the document on the document setting stand 4 to the registration roller 12. The primary paper feeding is followed by secondary paper feeding (step S13). The secondary paper feeding is to feed the document by the registration roller 12 and properly set the document in a predetermined position by the conveying belt 20.

The detailed control concerning the primary paper feeding and the secondary paper feeding will be described in detail after describing the whole processing.

In the step S14, it is then judged whether or not the SDF mode is selected. When the SDF mode switch 63 is turned on, it is judged that the SDF mode is selected. The SDF mode is a mode for feeding documents one at a time, in which the documents are not separated from each other at the time of the primary paper feeding. This mode is a mode so contrived that when soft documents or thin documents are fed, the documents are, for example, not jammed by the separation of the documents.

If it is judged that the SDF mode is selected, the SDF solenoid 38 described in FIG. 2 is turned off (step S15), the stopper solenoid 67 is turned off (step S16), and a flag f2 is reset (step S17).

When the stopper solenoid 67 is turned off, the stopper member 6 enters a state where it prevents a document from being fed as shown in FIG. 1. Accordingly, the subsequent document is inhibited from being fed. In addition, the flag f2 is a flag for indicating whether or not the document is fed by primary paper feeding. For example, the flag f2 indicates that the document is not fed by primary paper feeding if it is reset.

When in the step S14, the SDF mode is not selected, that is, the ADF mode which is a normal mode is selected, it is judged whether or not the document setting switch 5 is turned on (step S18). When there is a document on the document setting stand 4, the document setting switch 5 is turned on, so that the subsequent document is fed by primary paper feeding (step S19). In order to indicate that the document is fed by primary paper feeding, the flag f2 is set (step S20).

When there is no subsequent document, so that it is judged in the step S18 that the document setting switch 5 is turned off, the stopper solenoid 67 is turned off. Consequently, a passage is closed by the stopper member 6 (step S16), and the flag f2 is reset (step S17).

It is then judged whether or not processing on the side of the electrophotographic copying machine based on the document fed by secondary paper feeding, that is, copying is terminated, so that a "CHANGE" signal is inputted from the copying machine control section 69 (step S21). If it is judged that this signal is inputted, the conveying motor 21 and the discharge motor 30 are turned on (step S22), so that the discharge of the document is started. If the rear end of the document discharged is detected by the discharge switch 29 (step S23), the state of the flag f1 is judged (step S24). The flag f1 is a flag for indicating whether or not there is a document discharged on the discharged paper receiving section 36, as described above. There is a document on the discharged paper receiving section 36 when the flag f1 is set, while there is no document when it is reset. When the flag f1 is reset, so that there is no document on the discharged paper receiving section 36, the rotation speed of the discharge motor 30 is reduced to one third, and the flag f1 is set (step S25).

On the other hand, when the flag f1 is set in the step S24, so that there is a document on the discharged paper receiving section 36, the rotation speed of the discharge motor 30 is reduced to, for example, one fourth so as to be lower (step S26).

It is on the basis of the difference in coefficient of friction between the discharged paper receiving section 36 composed of resin or the like and a document and coefficient of friction between documents that the amount of deceleration of the discharge motor 30 is varied depending on whether or not there is a document on the discharged paper receiving section 36. Specifically, the coefficient of friction between the discharged paper receiving section 36 and the document is relatively large, so that the amount of deceleration is relatively decreased if there is no document on the discharged paper receiving section 36, while being increased if there is a document on the discharged paper receiving section 36. Consequently, the documents discharged on the discharged paper receiving section 36 are exactly arranged.

Furthermore, in control in the subsequent steps S27 to 32, the operating time of the discharge motor 30 is varied depending on the document size so that the discharge motor 30 is not rotated any more than necessary.

More specifically, in the step S27, the document size is judged. The document size is judged on the basis of signals of the size switches 13B and 13C or an output of the feed switch 14 as described later. If the document is of relatively small size less than Number 3 of series A in Japan Industrial Standard (JIS) as a result of the judgment in the step S27, a timer t3 is started (step S28). When the measurement of relatively short time made by the timer t3 is terminated (step S29), the discharge motor 30 is turned off (step S32).

On the other hand, if the document is of large size more than Number 3 of series A in Japan Industrial Standard as a result of the judgment in the step S27, the timer t2 is started (step S30), and the discharge motor 30 is rotated until the measurement of relatively long time made by the timer t2 is terminated (step S31). When the measurement of time made by the timer t2 is terminated (step S31), the discharge motor 30 is turned off (step S32).

The state of the flag f2 is then judged (step S33). The flag f2 indicates whether or not a document is fed by primary paper feeding, as described above. If the flag f2 is set, so that the document is fed by primary paper feeding, therefore, the program proceeds to the secondary paper feeding in the step S13 again.

On the other hand, if the flag f2 is reset, a document is not fed by primary paper feeding. Therefore, there is no document to be subsequently conveyed. Accordingly, the conveying motor 21 is turned off, so that the flag f1 and the flag f3 are reset to be initialized (step S34). The processing is returned to the step S1.

Figure 6:
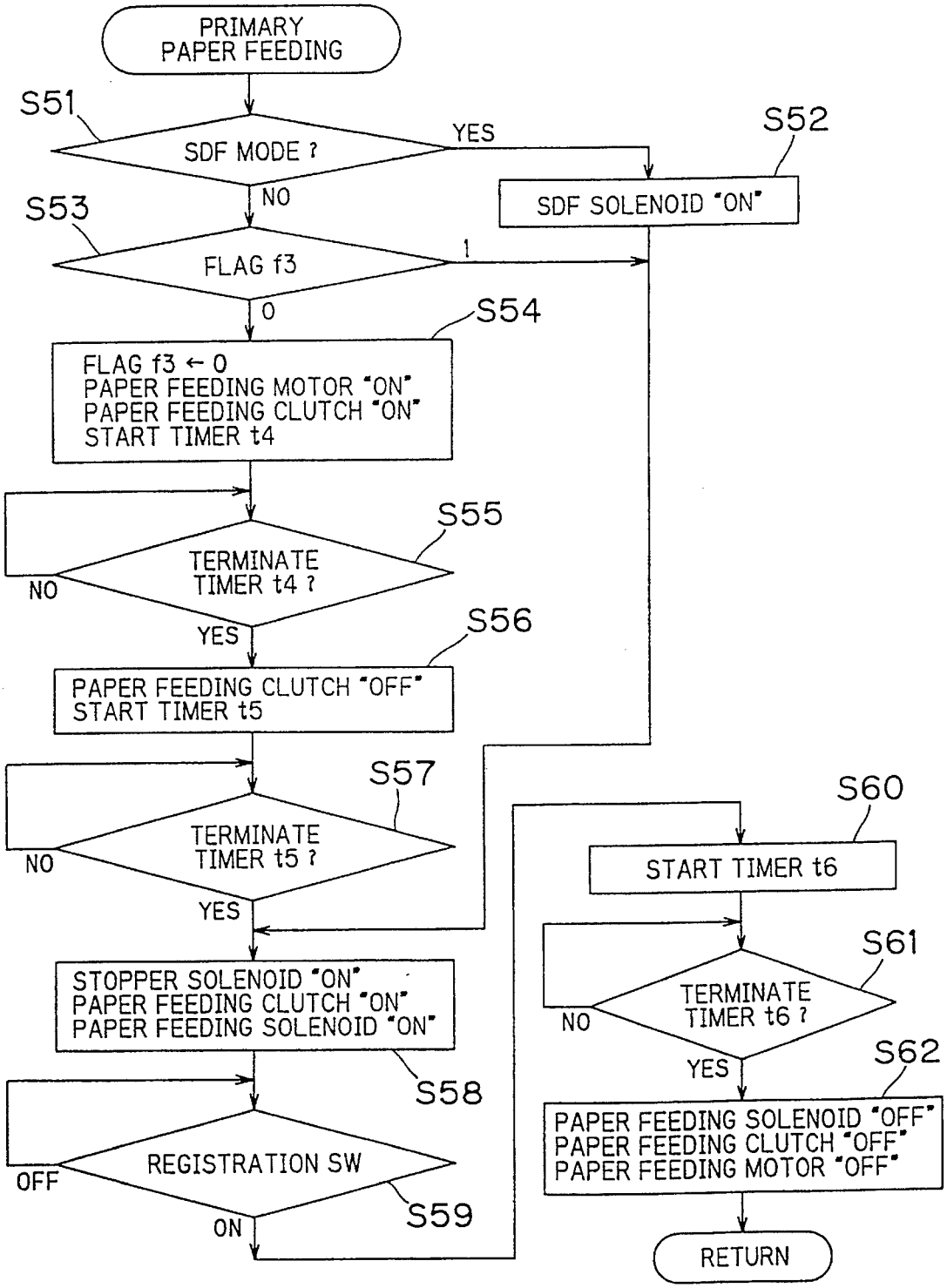
FIG. 6 is a flow chart showing the detailed contents of control concerning primary paper feeding.

FIG. 6 is a flow chart showing the detailed contents of control concerning the primary paper feeding described in the step S12 shown in FIG. 4. Referring now to FIG. 6, the control concerning the primary paper feeding will be described.

In the control concerning the primary paper feeding, it is first judged whether or not the SDF mode is selected (step S51).

If it is judged that the SDF mode is selected, the SDF solenoid 38 shown in FIG. 2 is turned on (step S52). When the SDF solenoid 38 is turned on, documents cannot be separated from each other by the separation plate 37, and the reverse roller 11 is not rotated in the reverse direction, not to perform processing for preventing the documents from being fed with they being overlapped with each other, as described in FIG. 2. In this case, the reverse roller 11 follows the paper feeding roller 10.

On the other hand, if it is judged in the step S51 that the SDF mode is not selected, that is, the ADF mode of continuous paper feeding which is a normal mode is selected, the state of the flag f3 is judged (step S53). The flag f3 is for indicating whether or not a document fed by primary paper feeding is the first document. The flag f3 is reset when the document fed by primary paper feeding is the first document, while being set when it is one of the second document and the subsequent documents. Control from the step S53 in which the state of the flag f3 is judged to the step S57 is processing performed so as to assure the properly operable state of the separation plate 37 and the reverse roller 11 when the mode is switched from the SDF mode to the ADF mode. Specifically, in the SDF mode, the joint mechanism 40 comes off the roller shaft 42, as shown in FIG. 2. When this state is changed into a state where the joint mechanism 40 is connected to the roller shaft 42, the engaging recession 49 and the engaging pin 50 may not, in some cases, engage with each other unless the joint mechanism 40 is rotated through a maximum of 180°. So-called backlash exists. In the steps S54 to S57, therefore, this backlash is eliminated.

More specifically, at the time of feeding the first document in a state where the flag f3 is reset, the flag f3 is first set. Consequently, the paper feeding motor 17 is turned on, and the paper feeding clutch 64 is turned on, so that the rotation of the forward roller 9 and the paper feeding roller 10 is started. In addition, a timer t4 is started (step S54). The timer t4 is for measuring fourth predetermined time required to correct the backlash. When the measurement of time made by the timer t4 is terminated (step S55), the paper feeding clutch 64 is turned off and at the same time, a timer t5 is started (step S56). The timer t5 is for measuring fifth predetermined time required for the coasting of the forward roller 9 and the paper feeding roller 10 to which the driving force from the paper feeding motor 17 is not transmitted to be completely stopped after the paper feeding clutch 64 is turned off. After the measurement of time made by the timer t5 is terminated, the feeding of the document is started.

More specifically, the stopper solenoid 67 is turned on so that the stopper member 6 is rotated in the counterclockwise direction to open the passage, the paper feeding clutch 64 is turned on so that the forward roller 9 and the paper feeding roller 10 are rotated, and the paper feeding solenoid 66 is turned on so that the front end of the document is brought into contact with the forward roller 9 by pressure by the document pressing member 15 (step S58).

When it is judged that the registration switch 13A is turned on after the primary paper feeding is started (step S59), a timer t6 is started (step S60). The timer t6 measures sixth predetermined time required to make the document flex in a so-called loop shape in the registration roller 12 to correct the oblique feeding of the document.

When the measurement of time made by the timer t6 is terminated (step S61), the paper feeding solenoid 66, the paper feeding clutch 64, and the paper feeding motor 17 are turned off (step S62).

The foregoing are the detailed contents of the control concerning the primary paper feeding in the present embodiment.

Figure 7:
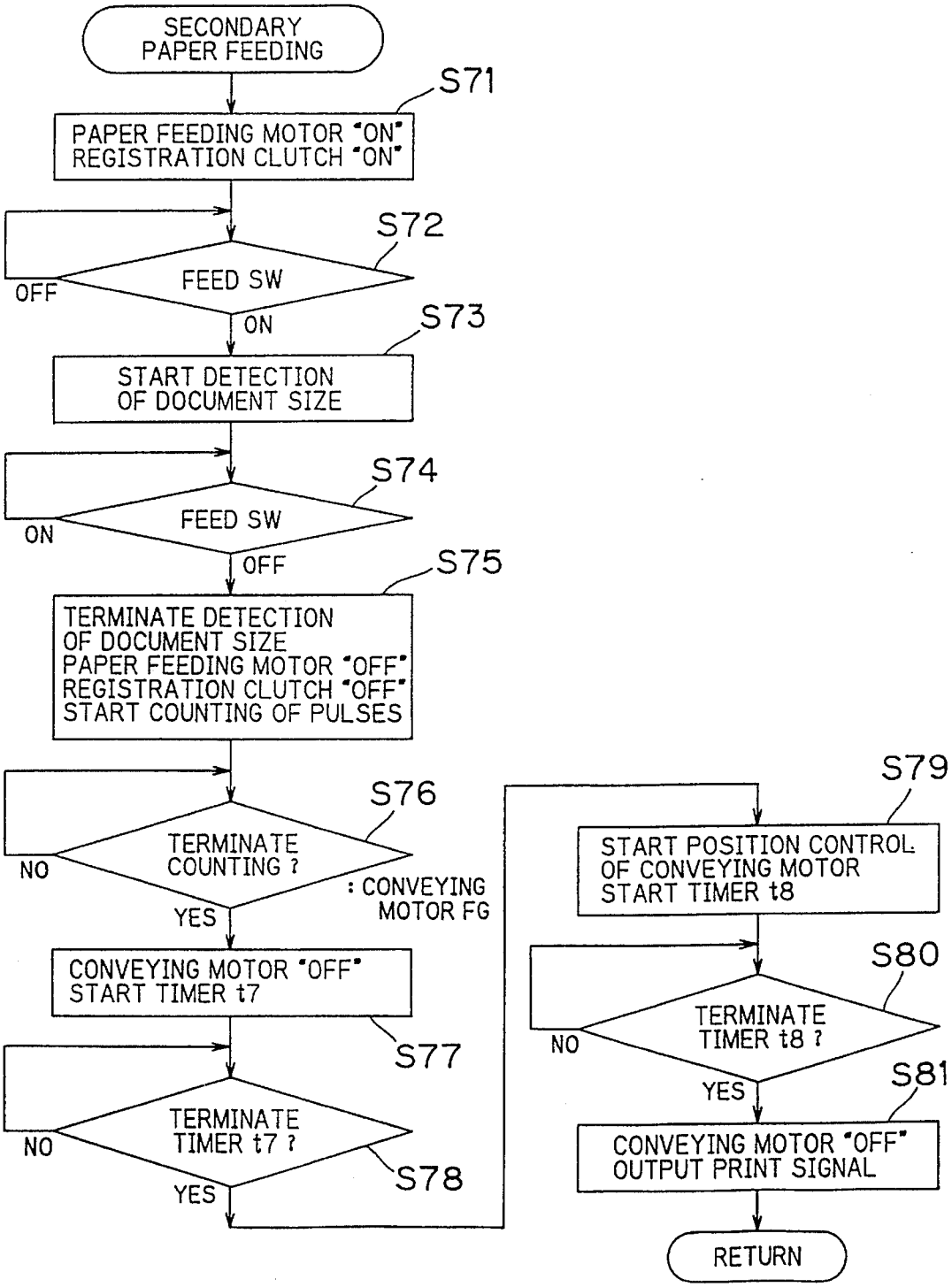
FIG. 7 is a flow chart showing the detailed contents of control concerning secondary paper feeding.

FIG. 7 is a flow chart showing the detailed contents of control concerning the secondary paper feeding described in the step S13 shown in FIG. 4. Referring now to FIG. 7, the control concerning the secondary paper feeding will be described.

In the control concerning the secondary paper feeding, the paper feeding motor 17 is first turned on, and the registration clutch 65 is turned on (step S71). Consequently, the rotation of the registration roller 12 is started, so that the conveyance of a document by the registration roller 12 is started.

When the front end of the document conveyed passes through the feed switch 14, the feed switch 14 is turned on. If it is judged that the feed switch 14 is changed from an off state to an on state (step S72), the detection of the document size is started (step S73). The size in the width direction in the document size is detected by the size switches 13B and 13C. The detection of the document size in the step S73 is for detecting the length of the document in the direction of conveyance. When the rear end of the document conveyed passes through the feed switch 14, the feed switch 14 is switched from an on state to an off state. If it is judged that the feed switch 14 is switched from an on state to an off state (step S74), the detection of the document size is terminated (step S75). The detection of the document size from the step S72 to the step S74 may be performed by, for example, measuring the ON time of the feed switch 14 or may be performed by counting the number of output pulses of the photointerrupter for a paper feeding motor 19 for the ON time.

Furthermore, the paper feeding motor 17 and the registration clutch 65 are turned off at the same time that the detection of the document size is terminated, so that counting of pulses outputted from the photointerrupter for a conveying motor 23 is started (step S75).

If the counting of a predetermined number of pulses is terminated (step S76), the conveying motor 21 is turned off (step S77).

It is at the time point where the rear end of the document conveyed passes through the feed switch 14 that the feed switch 14 is turned off. As shown in FIG. 1, there is a predetermined distance from the feed switch 14 to the reference line 26, so that the document must be further conveyed by this distance. In order to exactly control this amount of conveyance, the number of pulses of the photointerrupter for a conveying motor 23 is counted. The amount of conveyance by the conveying belt 20 is proportional to the number of output pulses of the photointerrupter for a conveying motor 23. Accordingly, the reference number of pulses of the photointerrupter for a conveying motor 23 which corresponds to the amount of conveyance from the feed switch 14 to a position just ahead of the reference line 26 has been previously detected, and an OFF signal is applied to the conveying motor 21 when the number of output pulses of the photointerrupter for a conveying motor 23 reaches the reference number of pulses.

In this case, the reference number of pulses may not be always constant but may be corrected depending on the document size detected in the step S75 or may be corrected depending on the type of document. The correction depending on the type of document may not be made or may be made depending on which of the ADF mode in which the automatic document conveying device conveys ordinary documents or the SDF mode in which it conveys thin documents is selected.

The reference number of pulses may be corrected in the following manner:

For example, the amount of correction of pulses Xn (n=1, 2, 3, . . . ) which is a value determined for each document size is previously set in a memory provided in the ADF main circuit control section 61, and the amount of correction of pulses Xn is added to the reference number of pulses X depending on the detected document size, to calculate the corrected number of pulses X'=X+Xn. An OFF signal may be applied to the conveying motor 21 when the number of output pulses of the photointerrupter for a conveying motor 23 reaches the corrected number of pulses X'.

Similarly, the amount of correction is not added in the case of the ADF mode, while the amount of correction corresponding to the thin documents may be added in the case of the SDF mode.

This makes it possible to apply the OFF signal to the conveying motor 21 when the rear end of the document reaches the position just ahead of the reference line 26 irrespective of the document size and the type of document.

Furthermore, in the step S77, the OFF signal is applied to the conveying motor 21 and at the same time, a timer t7 is started. The timer t7 is a timer for preventing an abnormal state. In the present embodiment, even if the OFF signal is applied to the conveying motor 21, the conveying motor 21 coasts and rotates by the inertia, to measure sufficient time required until the conveying motor 21 is completely stopped. A case where the timer t7 reaches the full count is an abnormal state even if the conveying motor 21 coasts and rotates. In this case, therefore, the program proceeds to the subsequent control irrespective of the coasting and rotation of the conveying motor 21.

When the measurement of time made by the timer t7 is terminated (step S78), position control of the conveying motor 21 is started and at the same time, a timer t8 is started (step S79). The position control of the conveying motor 21 is such control as to properly set the document so that the rear end of the document is brought into contact with the reference line 26 by rotating the conveying motor 21 in the reverse direction and switching the document back so that the rear end of the document collides with the document abutting member 25 provided on the reference line 26. The timer t8 measures sufficient time required for this position control. When the measurement of time made by the timer t8 is terminated (step S80), the OFF signal is applied to the conveying motor 21, so that a "PRINT" signal meaning that the setting of the document is completed is outputted to the copying machine control section 69 (step S81).

The foregoing are the detailed contents of the control concerning the secondary paper feeding.

Meanwhile, the present embodiment is characterized in that in the above described control concerning the secondary paper feeding, the amount of movement of the conveying belt 20 from the time when the OFF signal is applied to the conveying motor 21 to the time when it is judged that the conveying motor 21 is completely stopped is detected in the steps S77 and S78, and the conveying motor 21 is rotated in the reverse direction by the position control so as to return the conveying belt 20 by the above described detected amount of movement in the steps S79 and S80.

Figure 8:
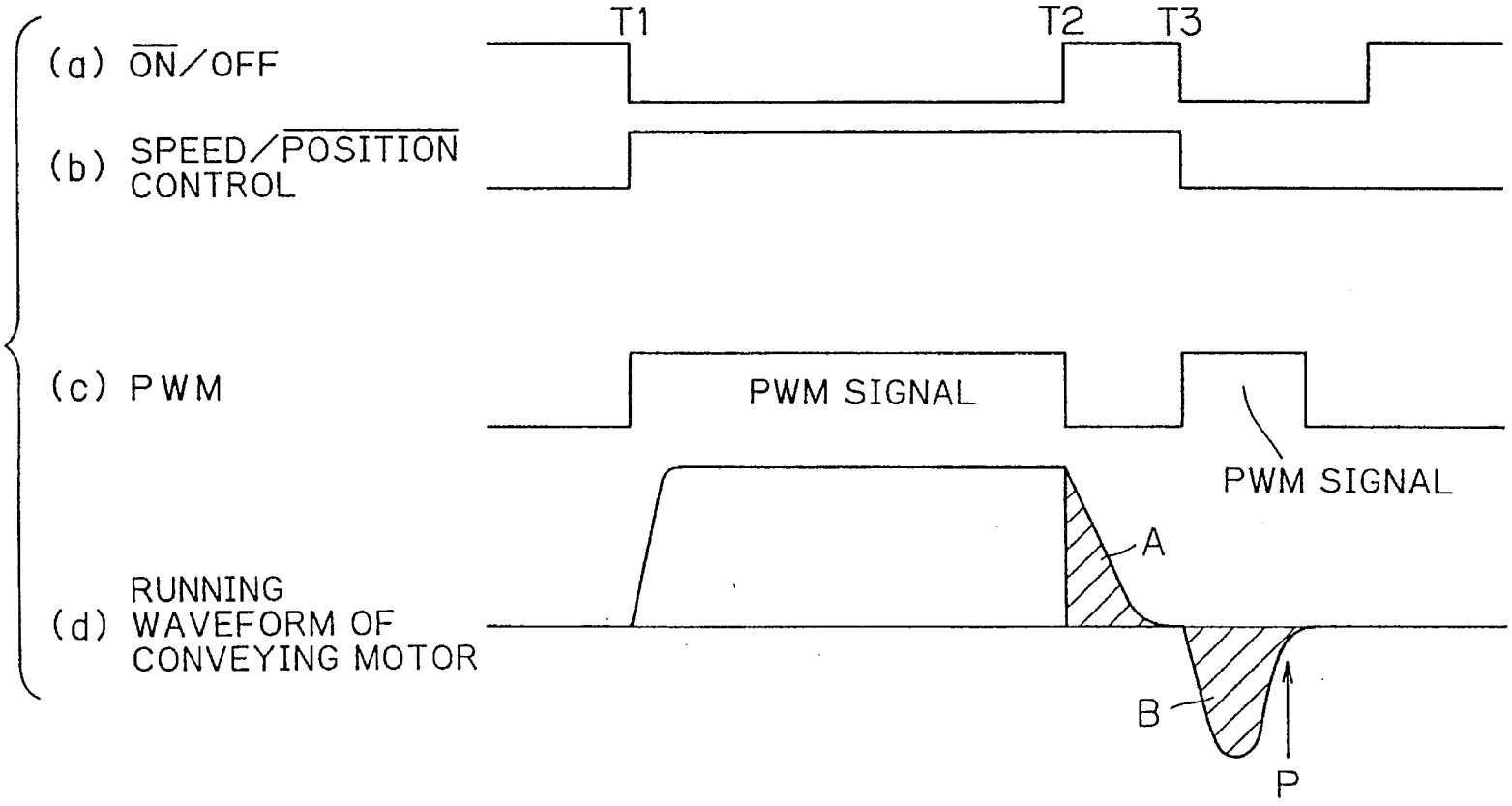
FIG. 8(*a*) to (*d*) is a waveform diagram for explaining the contents of control which characterizes a first embodiment.
Figure 9:
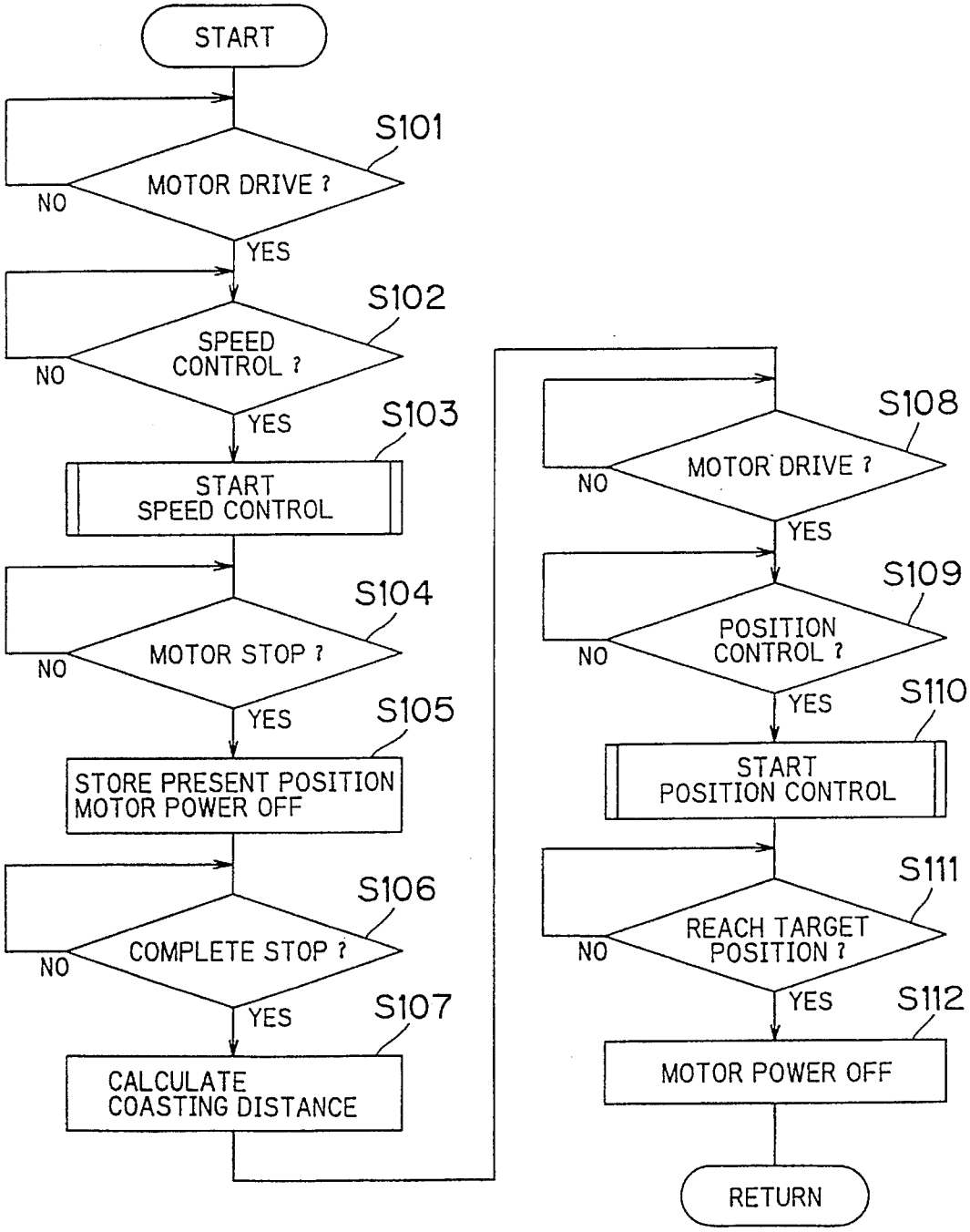
FIG. 9 is a flow chart showing the contents of control which characterizes the first embodiment.

Description is now made of the contents of control which characterizes the present embodiment while referring to a waveform diagram of FIG. 8 and a flow chart of FIG. 9. FIG. 9 is a flow chart with respect to the contents of control carried out by the motor control section 62 shown in FIG. 3.

At timing T1, an ON signal and a speed control signal of the conveying motor 21 are applied to the motor control section 62 from the ADF main circuit control section 61. This timing T1 is the step S4 or S22 in the whole flow chart described above. When the motor control section 62 judges that the ON signal and the speed control signal are inputted (steps S101 and S102), it applies, for example, a PWM signal for carrying out speed control to the conveying motor 21, to start the speed control (step S103). Accordingly, the running waveform of the conveying motor 21 is raised so that the conveying motor 21 is rotated at constant speed, as shown in a waveform diagram of FIG. 8(*d*).

Thereafter, at timing T2, an OFF signal of the conveying motor 21 is applied to the motor control section 62 from the ADF main circuit control section 61. This timing T2 at which the OFF signal is applied corresponds to the step S77 in the flow chart of FIG. 7. The timing T2 at which this OFF signal is applied to the motor control section 62 from the ADF main circuit control section 61 is the time point immediately before the rear end of a document fed by secondary paper feeding passes through the reference line 26. In addition, it is preferable that this timing T2 is corrected depending on the document size and the type of document, as described above.

The motor control section 62 stops to apply a PWM signal for speed control to the conveying motor 21 in response to input of the OFF signal. In addition, the motor control section 62 stores the present position. The storage of the present position is to always previously count a detection pulse applied from the photointerrupter for a conveying motor 23 by a counter and store the counted value at that time. Alternatively, it may be processing for resetting the counted value of the counter (step S105).

When the PWM signal is not applied from the motor control section 62, the conveying motor 21 is decelerated to be stopped, as shown in a waveform diagram of FIG. 8(*d*). It is because the conveying motor 21 has the inertia that the conveying motor 21 is not immediately stopped even if the PWM signal is not applied.

Therefore, in the motor control section 62, the detection pulse from the photointerrupter for a conveying motor 23 is counted in the step S105 in which the coasting by the inertia is started. When no detection pulse is applied from the photointerrupter for a conveying motor 23, and more specifically, when a state where the counted value of the counter for counting the detection pulse from the photointerrupter for a conveying motor 23 is not varied for a predetermined very short time continues, it is judged that the conveying motor 21 is completely stopped (step S106), and the coasting distance is calculated (step S107). The calculation of the coasting distance is to find the number of detection pulses from the photointerrupter for a conveying motor 23 counted from the step S105 to the step S106. This counted number corresponds to the area of a region A hatched in FIG. 8(*d*).

At timing T3, the ON signal and a position control signal of the conveying motor 21 are then applied to the motor control section 62 from the ADF main circuit control section 61. This timing T3 corresponds to the step S79 in the flow chart of FIG. 7 and the time point where the measurement of time made by the timer t7 is terminated from the timing T2.

When the motor control section 62 judges that the ON signal and the position control signal are inputted in the steps S108 and S109, it applies a PWM signal for reverse rotation to the conveying motor 21, to carry out position control (step S110).

The position control is such control as to reliably stop the conveying motor 21 in a target stop position by representing a command speed V by, for example, a linear function of position X.

More specifically, a value of a constant k times the counted number X representing the coasting distance calculated in the step S107 is applied to the conveying motor 21 as a command speed V (this command speed is outputted using, for example, a PWM signal). At this time, the counted number X is subtracted every time the detection pulse is applied from the photointerrupter for a conveying motor 23 as the conveying motor 21 is rotated. Consequently, in the position control, it is possible to rotate the conveying motor 21 in the reverse direction by the coasting distance corresponding to the area of the region A shown in FIG. 8(*d*). Specifically, it is possible to rotate the conveying motor 21 in the reverse direction by a distance corresponding to the area of a region B hatched in FIG. 8, that is, a distance equal to the coasting distance corresponding to the area of the region A.

When the command speed V becomes zero, that is, the counted value becomes zero, it is judged that the conveying motor 21 reaches a target position (step S111), so that the application of the PWM signal for position control to the conveying motor 21 from the motor control section 62 is stopped (step S112).

Control in the steps S110 to S112 is carried out within the time measured by the timer t8 in the step S80 shown in FIG. 7.

According to the present embodiment, it is possible to accurately stop the document in a predetermined position. Moreover, it is possible to reduce the stress applied to the document at the time of switching the document back, so that the document is hardly damaged. In addition, control for setting the document in a predetermined position and control for replacing the document with another document can be carried out in a short time.

Description is now made of an automatic document conveying device according to a second embodiment of the present invention. The present embodiment will be described while referring to FIGS. 1 to 7 again. Specifically, the mechanical construction of the automatic document conveying device according to the present embodiment is the same as the construction shown in FIGS. 1 and 2, and the electrical construction thereof is the same as the construction shown in FIG. 3. In addition, the entire procedure for control carried out by an ADF main circuit control section 61 and a motor control section 62 is the same as the procedure shown in FIGS. 4 and 5, and the contents of control concerning primary paper feeding are the same as the contents shown in FIG. 6. Furthermore, control concerning secondary paper feeding is approximately the same as the control shown in FIG. 7. The contents different from the contents in the above described first embodiment will be described.

In the present embodiment, in the step S77 shown in FIG. 7, a timer t7 which is started at the same time that an OFF signal is applied to a conveying motor 21 measures sufficient time required for deceleration control as described later. Specifically, the timer t7 is used for measuring sufficient time required for deceleration control proportional to time required until the conveying motor 21 is completely stopped after the OFF signal is applied to the conveying motor 21. The time measured by the timer t7 is preferably varied depending on the document size and/or the type of document.

When the measurement of time made by the timer t7 is terminated (step S78), position control of the conveying motor 21 is started and at the same time, a timer t8 is started (step S79). The position control of the conveying motor 21 is such control as to properly set a document so that the rear end of the document is brought into contact with a reference line 26 by rotating the conveying motor 21 in the reverse direction and switching the document back so that the rear end of the document collides with a document abutting member 25 provided on the reference line 26. The timer t8 measures sufficient time required for the position control. The time measured by the timer t8 is preferably varied depending on the document size and/or the type of document. When the measurement of time made by the timer t8 is terminated (step S80), an OFF signal is applied to the conveying motor 21, so that a "PRINT" signal meaning that the setting of the document is completed is outputted to a copying machine control section 69 (step S81).

The present embodiment is characterized in that in the control concerning secondary paper feeding, the conveying motor 21 is decelerated in proportion to time to be stopped by switching the conveying motor 21 from constant-speed control to deceleration control after the OFF signal of the conveying motor 21 is outputted and the amount of movement of the conveying belt 20 is detected to the time when it can be judged that the conveying motor 21 is completely stopped in the steps S77 and S78 shown in FIG. 7, and the conveying motor 21 is rotated in the reverse direction by the position control so as to return the conveying belt 20 by the above described detected amount of movement in the steps S79 and S80.

Figure 10:
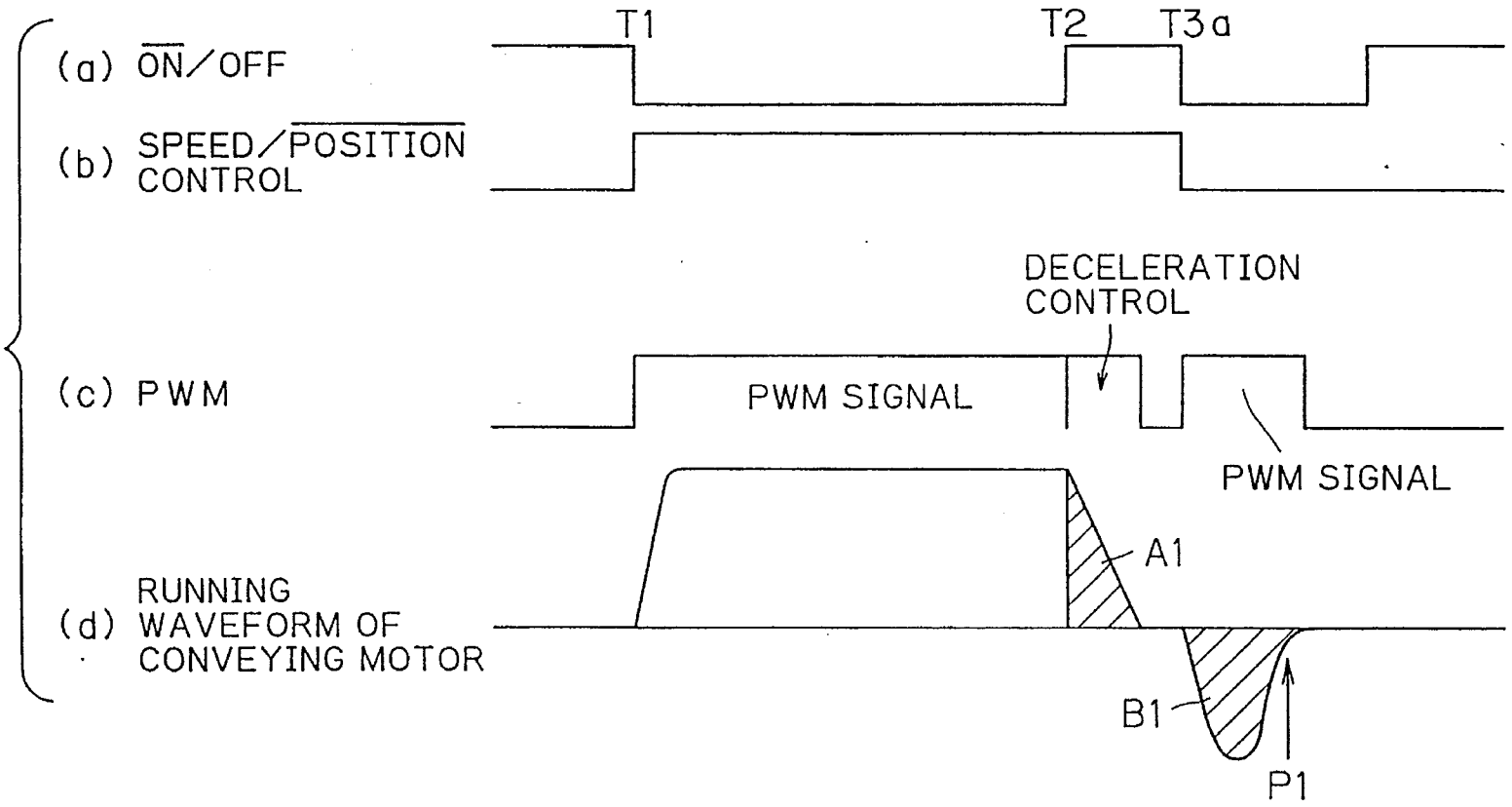
FIG. 10(*a*) to (*d*) is a waveform diagram for explaining the contents of control which characterizes the second and third embodiments.
Figure 11:
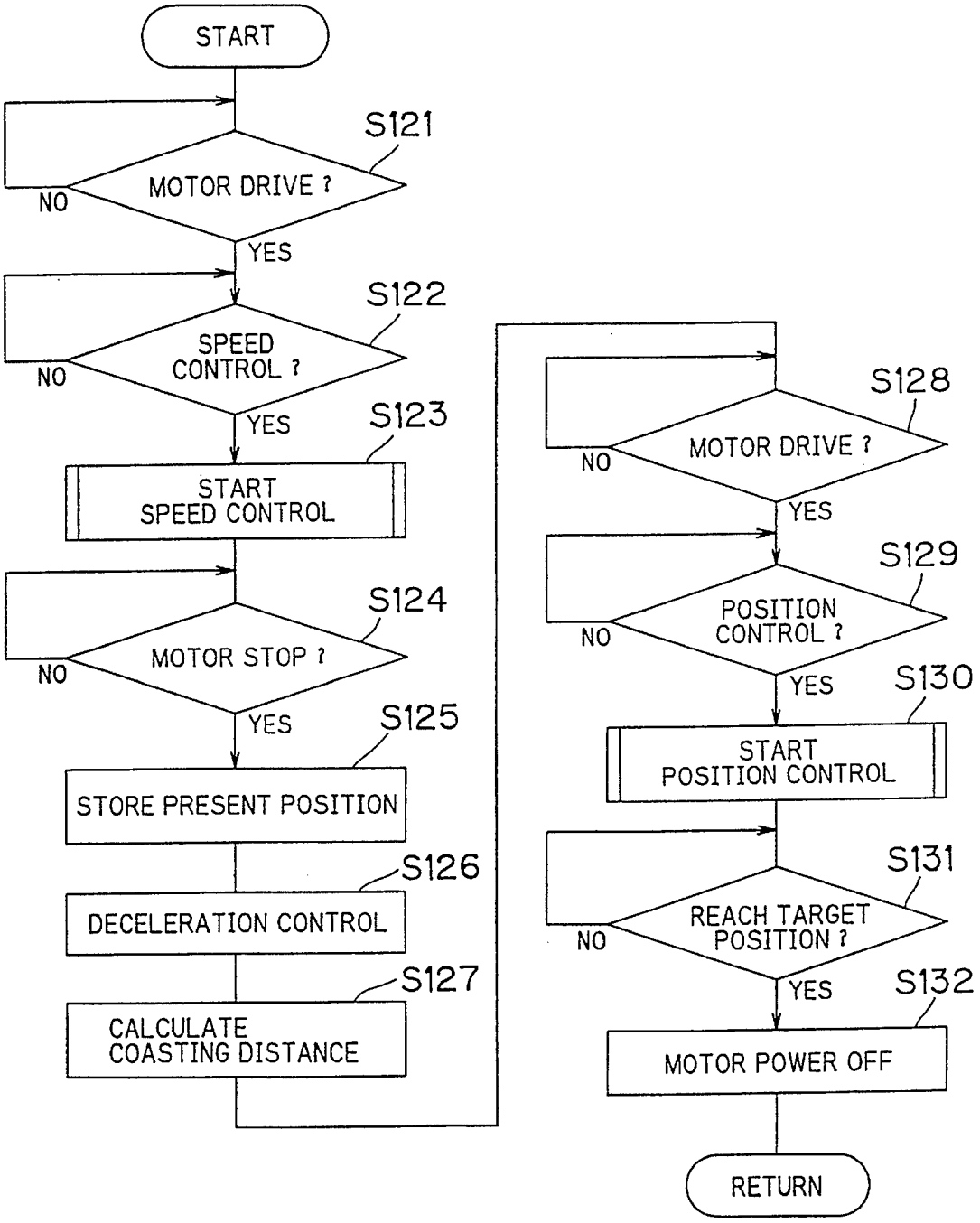
FIG. 11 is a flow chart showing the contents of control which characterizes the second and third embodiments.
Figure 12:
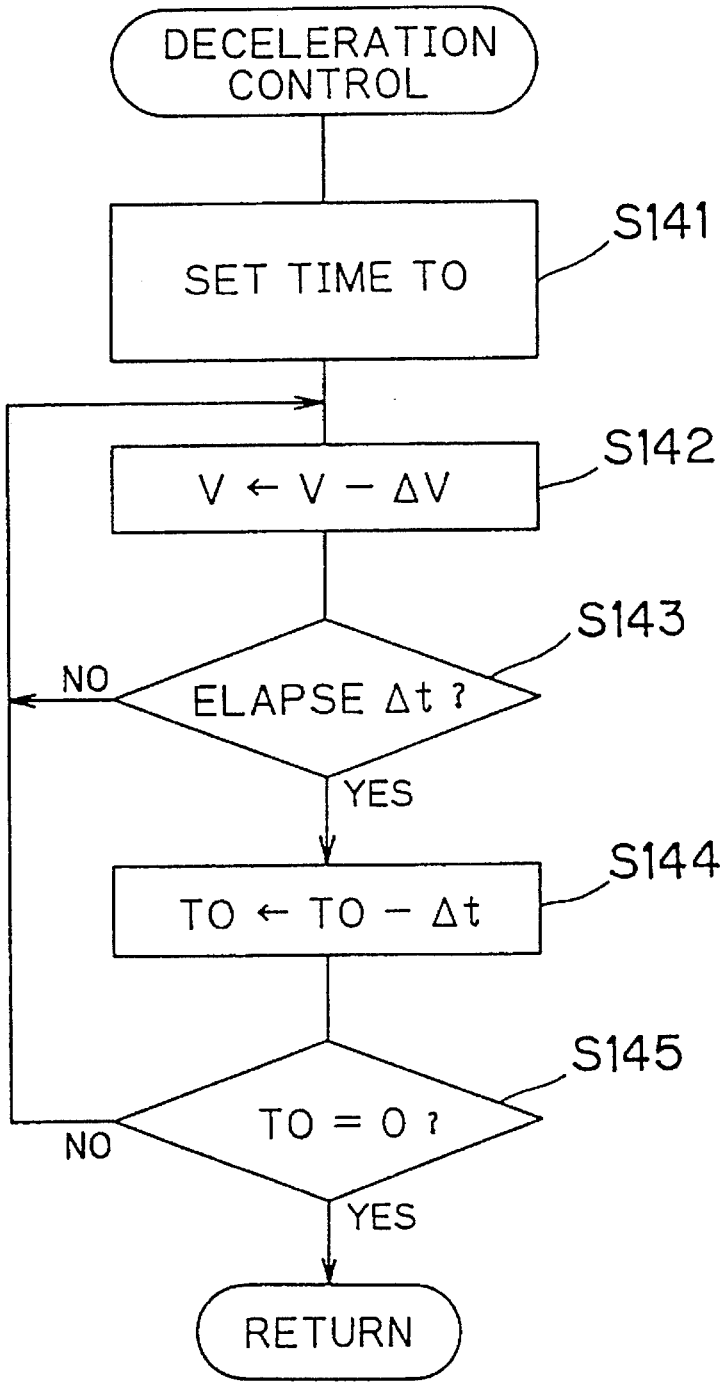
FIG. 12 is a flow chart showing the contents of deceleration control which characterizes the second embodiment.

Description is now made of the contents of control which characterizes the present embodiment while referring to a waveform diagram of FIG. 10, flow charts of FIGS. 11 and 12, and a memory map of FIG. 13. FIG. 11 is a flow chart centered with respect to the contents of control carried out by the motor control section 62 shown in FIG. 3.

At timing T1, an ON signal and a speed control signal of the conveying motor 21 are applied to the motor control section 62 from the ADF main circuit control section 61. This timing T1 corresponds to the step S4 shown in FIG. 4 or the step S22 shown in FIG. 5. When the motor control section 62 judges that the ON signal and the speed control signal are inputted (steps S121 and S122), it applies, for example, a PWM signal for carrying out speed control to the conveying motor 21, to start the speed control (step S123). Accordingly, the running waveform of the conveying motor 21 is raised so that the conveying motor 21 is rotated at constant speed, as shown in a waveform diagram of FIG. 10(*d*).

Thereafter, at timing T2, an OFF signal of the conveying motor 21 is applied to the motor control section 62 from the ADF main circuit control section 61. This timing T2 at which the OFF signal is applied corresponds to the step S77 in the flow chart of FIG. 7. The timing T2 at which this OFF signal is applied to the motor control section 62 from the ADF main circuit control section 61 is the time point immediately before the rear end of the document fed by secondary paper feeding passes through the reference line 26. In addition, it is preferable that this timing T2 is corrected depending on the document size and the type of document, as described above.

The motor control section 62 stores the present position in response to input of the OFF signal. The storage of the present position is to always previously count a detection pulse applied from a photointerrupter for a conveying motor 23 by a counter and store the counted value of the counter at that time. Alternatively, it may be processing for resetting the counted value of the counter (step S125).

Furthermore, the motor control section 62 switches constant-speed control of the conveying motor 21 to deceleration control proportional to time in response to the input of the OFF signal, to carry out the deceleration control of the conveying motor 21 for the target stopping time (step S126). Consequently, the movement of the conveying belt 20 caused by the inertia of the conveying motor 21 is restrained. One example of the deceleration control in the step S126 is shown in a flow chart of FIG. 12.

Referring to FIG. 12, description is made of the deceleration control. First, the target stopping time T0 is set (step S141). This target stopping time T0 is previously set in a memory provided in the motor control section 62. As this target stopping time T0, values are respectively set depending on the document size and the type of document, as shown in, for example, a memory map of FIG. 13. Therefore, the target stopping time is read out and set depending on the document size which is detected in the step S75 as described above and the type of document which is judged by the judgment as to whether or not an SDF mode is selected in the step S51.

More specifically, if the document size is A3Y, A3R, B3Y, B4Y or A2R (A or B at the head of each size means series A or series B in Japanese Industrial Standard, and Y or R at the end of each size indicates longitudinal feeding or transverse feeding), the target stopping time is set to 90 msec.

On the other hand, if the document size is other than the foregoing, the target stopping time is set to 30 msec.

Furthermore, if the type of document is a thin document, that is, the SDF mode is selected, the target stopping time is set to 90 msec. On the other hand, if the type of document is an ordinary document, that is, an ADF mode is selected, the target stopping time is set to 30 msec.

Additionally, if the target stopping time set depending on either one of the document size and the type of document is 90 msec which is longer, the time (90 msec) is preferentially set as the target stopping time.

A command speed V (this command speed V is a command speed in a case where the conveying motor 21 is controlled at constant speed) is then changed into a command speed obtained by decreasing the command speed V by $\Delta V$ (step S142), and it is judged whether or not very small time $\Delta t$ has elapsed (step S143).

When the very small time $\Delta t$ has elapsed, the very small time $\Delta t$ is subtracted from the target stopping time T0, to judge whether or not the resulted time T0 becomes zero (step S125). If the time T0 is not zero, the command speed is reduced by $\Delta V$, to repeat the same processing.

When the time T0 becomes zero, it is judged that the conveying motor 21 is stopped, so that the program proceeds to the step S127 shown in FIG. 11. The target stopping time may be always constant without being varied depending on the document size and the type of document.

In the step S127, the coasting distance is calculated. The calculation of the coasting distance is to find the number of detection pulses from the photointerrupter for a conveying motor 23 counted from the steps S125 to the step S126. This counted number corresponds to the area of a region A1 hatched in FIG. 10(*d*).

At timing T3*a*, the ON signal and a position control signal of the conveying motor 21 are then applied to the motor control section 62 from the ADF main circuit control section 61. This timing T3*a* corresponds to the step S79 in the flow chart of FIG. 7 and the time point where the measurement of time made by the timer t7 is terminated from the timing T2.

When the motor control section 62 judges that the ON signal and the position control signal are inputted in the steps S128 and S129, it applies a PWM signal for reverse rotation to the conveying motor 21, to carry out position control (step S130).

The position control is such control as to reliably stop the conveying motor 21 in a target stop position by representing the command speed V by, for example, a linear function of position X.

More specifically, a value of a constant k times the counted number X representing the coasting distance calculated in the step S127 is applied to the conveying motor 21 as a command speed V (this command speed is outputted using, for example, a PWM signal). At this time, the counted number X is subtracted every time the detection pulse is applied from the photointerrupter for a conveying motor 23 as the conveying motor 21 is rotated. Consequently, in the position control, it is possible to rotate the conveying motor 21 in the reverse direction by the coasting distance corresponding to the area of the region A shown in FIG. 10(*d*). Specifically, it is possible to rotate the conveying motor 21 in the reverse direction by a distance corresponding to the area of a region B1 hatched in FIG. 10(*d*), that is, a distance equal to the coasting distance corresponding to the area of the region A1.

When the command speed V becomes zero, that is, the counted value becomes zero, it is judged that the conveying motor 21 reaches a target position (step S131), so that the application of the PWM signal for position control to the conveying motor 21 from the motor control section 62 is stopped (step S132).

Control in the steps S130 to S132 is carried out within the time measured by the timer t8 in the step S80 shown in FIG. 7.

According to the present embodiment, it is possible to carry out such control that the document does not slip when the document is overrun to be stopped as well as to reliably stop the conveying belt 20 in a short time.

Description is now made of an automatic document conveying device according to a third embodiment of the present invention. The present embodiment will be described while referring to FIGS. 1 to 7 and FIGS. 10 and 11 again. Specifically, the mechanical construction of the automatic document conveying device according to the present embodiment is the same as the construction shown in FIGS. 1 and 2, and the electrical construction thereof is the same as the construction shown in FIG. 3. In addition, the entire procedure for control carried out by an ADF main circuit control section 61 and a motor control section 62 is the same as the procedure shown in FIGS. 4 and 5, and the contents of control concerning primary paper feeding is the same as the contents shown in FIG. 6. Furthermore, control concerning secondary paper feeding is approximately the same as the control shown in FIG. 7. Additionally, the detailed control concerning the secondary paper feeding is similar to that in the second embodiment described with reference to FIGS. 10 and 11. The contents different from the contents in the above described second embodiment will be described.

In the present embodiment, in the step S77 shown in FIG. 7, a timer t7 which is started at the same time that an OFF signal is applied to a conveying motor 21 measures time required for deceleration control as described later. Specifically, the timer t7 is used for measuring sufficient time required for deceleration control proportional to the distance at which the conveying motor 21 is moved until it is completely stopped after the OFF signal is applied to the conveying motor 21. The time measured by the timer t7 is preferably varied depending on the document size and/or the type of document.

When the measurement of time made by the timer t7 is terminated (step S78), position control of the conveying motor 21 is started and at the same time, a timer t8 is started (step S79). The position control of the conveying motor 21 is such control as to properly set a document so that the rear end of the document is brought into contact with a reference line 26 by rotating the conveying motor 21 in the reverse direction and switching the document back so that the rear end of the document collides with a document abutting member 25 provided on the reference line 26. The timer t8 measures sufficient time required for this position control. The time measured by the timer t8 is preferably varied depending on the document size and/or the type of document. When the measurement of time made by the timer t8 is terminated (step S80), an OFF signal is applied to the conveying motor 21, so that a "PRINT" signal meaning that the setting of the document is completed is outputted to a copying machine control section 69 (step S81).

The present embodiment is characterized in that in the above described control concerning secondary paper feeding, the conveying motor 21 is decelerated in proportion to the distance at which the conveying motor 21 is moved in a first direction (rightward in FIG. 7) to be stopped by switching the conveying motor 21 from constant-speed control to deceleration control after the OFF signal of the conveying motor 21 is outputted and the amount of movement of the conveying belt 20 to the time when it can be judged that the convening motor 21 is completely stopped in the steps S77 and S78, and the conveying motor 21 is rotated in the reverse direction by the position control so as to return the conveying belt 20 by the above described detected amount of movement in the steps S79 and 80.

In this case, various signal waveforms and the running waveform of the conveying motor 21 at the time of control become waveforms similar to the various waveforms shown in FIGS. 10(*a*) to 10(*d*). In addition, approximately the same control as that shown in FIG. 11 is carried out with respect to the conveying motor 21.

The most characteristic difference of the present embodiment from the above described second embodiment is the details of processing in the step S126 shown in FIG. 11. The contents are shown in a flow chart of FIG. 14.

Figure 14:
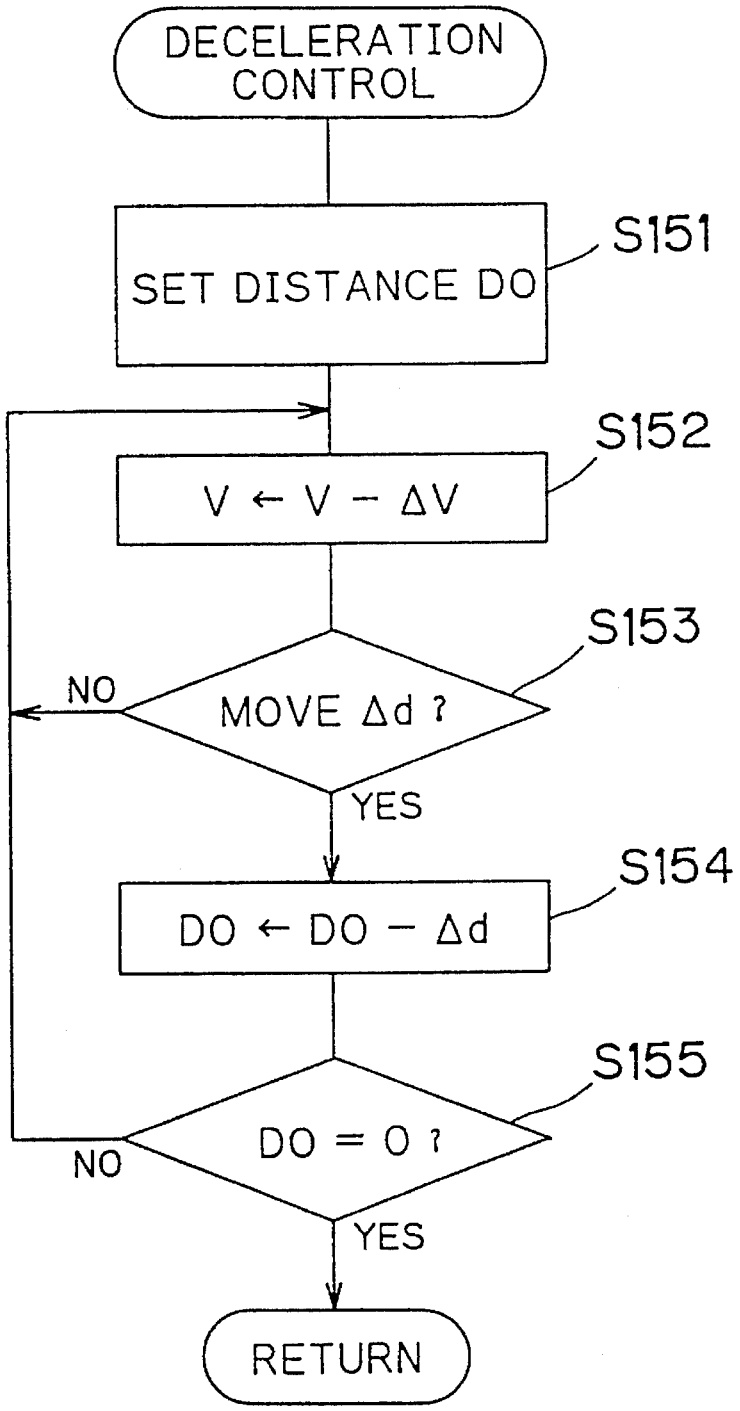
FIG. 14 is a flow chart showing the contents of deceleration control which characterizes the third embodiment.

Referring to FIG. 14, description is made of the deceleration control. First, the target stopping distance D0 is set (step S151). This target stopping distance D0 is previously set in a memory provided in the motor control section 62. As this target stopping distance D0, values are respectively set depending on the document size and the type of document, as shown in, for example, a memory map of FIG. 15. Therefore, the target stopping distance is read out and set depending on the document size which is detected in the step S75 as described above and the type of document which is judged by the judgment as to whether or not an SDF mode is selected in the step S51.

More specifically, if the document size is A3Y, A3R, B3Y, B4Y or A2R, the target stopping distance is set to, for example, 45 mm.

On the other hand, if the document size is other than the foregoing, the target stopping distance is set to, for example, 21 mm.

Furthermore, if the type of document is a thin document, that is, the SDF mode is selected, the target stopping distance is set to, for example, 45 mm. On the other hand, if the type of document is an ordinary document, that is, an ADF mode is selected, the target stopping distance is set to, for example, 21 mm.

Additionally, if the target stopping distance set depending on either one of the document size and the type of document is 45 mm which is long, the distance is preferentially set as the target stopping distance.

A command speed V (this command speed V is a command speed in a case where the conveying motor 21 is controlled at constant speed) is then changed into a command speed obtained by decreasing the command speed V by ΔV (step S152), and it is judged whether or not the document is moved by a very small distance Δd (step S153).

When the document is moved by the very small distance Δd, the very small distance Δd is subtracted from the target stopping distance D0, to judge whether or not the resulted distance D0 becomes zero (step S155). If the distance D0 is not zero, the command speed is reduced by ΔV, to repeat the same processing.

When the distance D0 becomes zero, it is judged that the conveying motor 21 is stopped, so that the program proceeds to the step S127 shown in FIG. 11. The target stopping distance may be always constant without being varied depending on the document size and the type of document.

The same effect as that in the above described second embodiment is obtained even by such deceleration control.

Although the present embodiments of the present invention were made as described in the foregoing, the present invention is not limited to the above described respective embodiments. For example, the position control in the step S110 shown in FIG. 9 and the step S130 shown in FIG. 11 as described above may be carried out not by indicating a command speed V by a linear function of position X but setting $V=\sqrt{2AX}$ (where A is acceleration). The details of such position control is disclosed in the prior application of the present applicant (Patent Application No. 340025/1990 (see Japanese Patent Laid-Open Gazette No. 22975/1993)).

Furthermore, in the above described position control, when the conveying motor 21 is rotated in the reverse direction by a distance corresponding to the area of a region B or B1 hatched, it is in a position indicated by a point P in FIG. 8 or a position indicated by a point P1 in FIG. 10 that the rear end of the document collides with the document abutting member 25 (see FIG. 1) provided on the reference line 26. The reason for this is that the timing T2 at which the OFF signal is applied is not the time when the rear end of the document passes through the reference line 26 but the time point immediately before the time. Therefore, the speed at which the rear end of the document collides with the document abutting member 25 can be controlled to not more than a predetermined speed previously determined. If the speed at which the rear end of the document collides with the document abutting member 25 is thus decreased, the stress applied to the document by the collision can be reduced.

The speed of the conveying motor 21 at the above described points P and P1 depends on timing T2 at which the OFF signal is outputted to the conveying motor 21 (which is outputted in the step S77 shown in FIG. 7). Specifically, if the timing T2 at which the OFF signal is applied to the conveying motor 21 is set to the time point far ahead of the reference line 26 by decreasing the number of reference pulses, the points P and P1 are shifted left in FIGS. 8 or 10. On the other hand, if the OFF signal is applied to the conveying motor 21 when the rear end of the document just reaches the reference line 26 by increasing the number of reference pulses in the step S77, the point P shown in FIG. 8 and the point P1 shown in FIG. 10 can be shifted right.

It is thus possible to control the speed in a case where the rear end of the document in reverse rotation control (position control) of the conveying motor 21 collides with the document abutting member 25 at timing at which the OFF signal is outputted to the conveying motor 21 when the conveying motor 21 is rotated in the forward direction.

Furthermore, this speed at the time of the collision may be corrected depending on the document size and the type of document.

Additionally, a pulse output device for outputting a pulse as the conveying belt 20 is moved in place of the detection pulse from the photointerrupter for a conveying motor 23 may be provided to carry out position control using the pulse.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A paper conveying device comprising:

paper conveying means moved in a first direction to convey paper in the first direction and moved in a second direction to convey the paper in the second direction;

pulse outputting means for outputting pulses in sychronism with the movement of the paper conveying means;

driving signal outputting means for applying a driving signal to the paper conveying means to move the paper conveying means in the first direction and stopping the application of the driving signal at timing when the paper conveyed in the first direction by the paper conveying means is conveyed to a predetermined position;

counting means for counting a number of pulses outputted from the pulse outputting means after the application of the driving signal from the driving signal outputting means is stopped so as to detect a distance at which the paper conveying means is moved by its inertia even after the application of the driving signal is stopped; and position controlling means for moving the paper conveying means in the second direction by a distance corresponding to the number of pulses counted, said position controlling means including means for moving the paper conveying means in the second direction at a speed proportional to said number of pulses counted and means for varying said number of pulses counted by a number of pulses outputted from the pulse outputting means as the paper conveying means is moved in the second direction, said position controlling means controlling a speed at which the paper conveying means is moved so that the speed is not more than a predetermined speed in the vicinity of a target position where the movement in the second direction is terminated.

2. A paper conveying device according to claim 1, wherein the paper conveying means comprises a conveying motor, and the pulse outputting means outputs pulses in synchronism with the rotation of the conveying motor.

3. A paper conveying device comprising:

paper conveying means moved in a first direction to convey paper in the first direction and moved in a second direction to convey the paper in the second direction;

pulse outputting means for outputting pulses in synchronism with the movement of the paper conveying means;

driving signal outputting means for applying a driving signal to the paper conveying means to move the paper conveying means in the first direction at a predetermined speed and stopping the application of the driving signal at timing when the paper conveyed in the first direction by the paper conveying means is conveyed to a predetermined position;

deceleration controlling means for carrying out deceleration control of the paper conveying means to stop the paper conveying means in response to the stop of the application of the driving signal from the driving signal outputting means, the deceleration controlling means carrying out the deceleration control in proportion to time within a target stopping time previously set;

counting means for counting a number of pulses outputted from the pulse outputting means while the deceleration control of the paper conveying means is carried out by the deceleration controlling means; and position controlling means for moving the paper conveying means in the second direction by a distance corresponding to the number of pulses counted.

4. A paper conveying device according to claim 3, wherein the target stopping time is set depending on the paper size.

5. A paper conveying device according to claim 3, wherein the target stopping time is set depending on the type of paper.

6. A paper conveying device comprising:

paper conveying means moved in a first direction to convey paper in the first direction and moved in a second direction to convey the paper in the second direction;

pulse outputting means for outputting pulses in synchronism with the movement of the paper conveying means;

driving signal outputting means for applying a driving signal to the paper conveying means to move the paper conveying means in the first direction at a predetermined speed and stopping the application of the driving signal at timing when the paper conveyed in the first direction by the paper conveying means is conveyed to a predetermined position;

deceleration controlling means for carrying out deceleration control of the paper conveying means to stop the paper conveying means in response to the stop of the application of the driving signal from the driving signal outputting means, the deceleration controlling means carrying out the deceleration control in proportion to a distance at which the paper conveying means is moved in the first direction within the range of a target stopping distance previously set;

counting means for counting a number of pulses outputted from the pulse outputting means while the deceleration control of the paper conveying means is carried out by the deceleration controlling means; and position controlling means for moving the paper conveying means in the second direction by a distance corresponding to the number of pulses counted.

7. A paper conveying device according to claim 6, wherein the target stopping distance is set depending on the paper size.

8. A paper conveying device according to claim 6, wherein the target stopping distance is set depending on the type of paper.

9. A paper conveying device comprising:

paper conveying means moved in a first direction to convey paper in the first direction and moved in a second direction to convey the paper in the second direction;

pulse outputting means for outputting pulses in synchronism with the movement of the paper conveying means;

driving signal outputting means for applying a driving signal to the paper conveying means to move the paper conveying means in the first direction at a predetermined speed and stopping the application of the driving signal at timing when the paper conveyed in the first direction by the paper conveying means is conveyed to a predetermined position;

deceleration controlling means for carrying out deceleration control of the paper conveying means to stop the paper conveying means in response to the stop of the application of the driving signal from the driving signal outputting means;

counting means for counting a number of pulses outputted from the pulse outputting means while the deceleration control of the paper conveying means is carried out by the deceleration controlling means; and position controlling means for moving the paper conveying means in the second direction by a distance corresponding to the number of pulses counted, said position controlling means including means for moving the paper conveying means in the second direction at a speed proportional to said number of pulses counted and means for varying said number of pulses counted by a number of pulses outputted from the pulse outputting means as the paper conveying means is moved in the second direction, said position controlling means controlling a speed at which the paper conveying means is moved so that the speed is not more than a predetermined speed in the vicinity of a target position where the movement in the second direction is terminated.

10. A paper conveying device according to claim 9, wherein the paper conveying means comprises a conveying motor, and the pulse outputting means outputs pulses in synchronism with the rotation of the conveying motor.

11. A paper conveying method comprising the steps of:

moving a paper conveying means in a first direction to convey paper in the first direction; detecting, by counting a number of output pulses from a pulse outputting means for outputting a pulse in response to moving of paper conveying means, a distance at which the paper conveying means is moved by its inertia after the rear end of the paper reaches a predetermined reference position;

moving the paper conveying means in a second direction opposite to the first direction by the distance detected in the detecting step; and decreasing a speed at which the paper conveying means is moved as the paper conveying means is moved in the second direction, the speed being not more than a predetermined speed immediately before the rear end of the paper reaches the reference position.

12. A method according to claim 11, wherein the paper conveying means is decelerated after the rear end of the paper reaches the reference position, to restrain the movement of the paper conveying means by the inertia.

13. A method according to claim 11, wherein the paper conveying means is decelerated in proportion to time after the rear end of the paper reaches the reference position, to restrain the movement of the paper conveying means by the inertia.

14. A method according to claim 11, wherein the paper conveying means is decelerated in proportion to a distance at which the paper conveying means is moved in the first direction after the rear end of the paper reaches the reference position, to restrain the movement of the paper conveying means by the inertia.

* * * * *